US011700916B2

(12) United States Patent
Kilgore et al.

(10) Patent No.: US 11,700,916 B2
(45) **Date of Patent: *Jul. 18, 2023**

(54) FOOTWEAR HEEL SUPPORT DEVICE

(71) Applicant: NIKE, Inc., Beaverton, OR (US)

(72) Inventors: Elizabeth A. Kilgore, Portland, OR (US); Austin Orand, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/516,762

(22) Filed: Nov. 2, 2021

(65) Prior Publication Data

US 2022/0053884 A1 Feb. 24, 2022

Related U.S. Application Data

(63) Continuation of application No. 16/751,508, filed on Jan. 24, 2020, now Pat. No. 11,191,321.

(60) Provisional application No. 62/805,037, filed on Feb. 13, 2019.

(51) Int. Cl.

| | |
|---|---|
| ***A43B 23/08*** | (2006.01) |
| ***A43B 3/00*** | (2022.01) |
| ***A43B 23/02*** | (2006.01) |
| ***A43B 11/00*** | (2006.01) |

(52) U.S. Cl.

CPC ..... *A43B 23/088* (2013.01); *A43B 3/0036* (2013.01); *A43B 11/00* (2013.01); *A43B 23/0235* (2013.01)

(58) Field of Classification Search

CPC ..... A43B 23/08; A43B 23/088; A43B 11/00; A43B 11/02

USPC ..... 36/58.5, 69, 138

See application file for complete search history.

(56) References Cited

U.S. PATENT DOCUMENTS 2,693,039 A * 11/1954 Balut ..... A43B 3/101 36/51
2,736,110 A * 2/1956 Hardimon ..... A43B 23/08 36/58.5
2,920,402 A * 1/1960 Minera ..... A43B 3/102 36/58.5

(Continued)

FOREIGN PATENT DOCUMENTS

CN 2253129 Y 4/1997
CN 1166998 A 12/1997

(Continued)

OTHER PUBLICATIONS

Merrell Winter Climbing Shoes Polar Land 6 Released, Stylogue.co.kr, https://blog.naver.com/th_media/220192038921, Nov. 26, 2014.

*Primary Examiner* — Marie D Bays
(74) *Attorney, Agent, or Firm* — Quinn IP Law

(57) ABSTRACT

An article of footwear includes an upper defining a foot-receiving cavity with a heel region, and a heel support device extending around the rear of a heel region from a lateral side to a medial side. The heel support device may include a plurality of slats and a base, the plurality of slats providing a progressive gradient of lengths and/or widths, and/or one or more pegs extending from the device for attachment to a footwear upper, and/or an elongated tip that may be disposed in a cavity of an extension of a heel collar of the upper.

18 Claims, 15 Drawing Sheets

(56) References Cited

U.S. PATENT DOCUMENTS

| | | | | |
|---|---|---|---|---|
| 3,146,535 | A * | 9/1964 | Owings | A43B 11/00 36/58.6 |
| 3,425,075 | A * | 2/1969 | Murray | A43B 9/00 156/212 |
| 3,810,318 | A | 5/1974 | Epstein | |
| 4,026,047 | A | 5/1977 | Ahmer | |
| 4,864,736 | A | 9/1989 | Bierk | |
| 5,678,330 | A | 10/1997 | Van Dyke et al. | |
| 5,822,888 | A | 10/1998 | Terry | |
| 6,000,148 | A * | 12/1999 | Cretinon | A43B 5/002 36/88 |
| 6,079,128 | A | 6/2000 | Hoshizaki et al. | |
| 6,726,225 | B1 | 4/2004 | Stewart et al. | |
| 7,698,836 | B2 | 4/2010 | Schmelzer et al. | |
| 10,617,174 | B1 * | 4/2020 | Hopkins | A43B 23/088 |
| 10,638,810 | B1 * | 5/2020 | Cheney | A43B 3/00 |
| 10,905,192 | B1 * | 2/2021 | Cheney | A43B 23/027 |
| 11,191,321 | B2 * | 12/2021 | Kilgore | A43B 11/00 |
| 2001/0011430 | A1 | 8/2001 | Davis et al. | |
| 2001/0022434 | A1 | 9/2001 | Sauter et al. | |
| 2002/0133977 | A1 | 9/2002 | Pan | |
| 2006/0003160 | A1 | 1/2006 | Goldberg | |
| 2006/0196079 | A1 | 9/2006 | Terlizzi et al. | |
| 2008/0000106 | A1 * | 1/2008 | Culpepper | A43B 23/17 36/58 |
| 2008/0005933 | A1 | 1/2008 | Auger et al. | |
| 2011/0083341 | A1 | 4/2011 | Baum | |
| 2016/0374427 | A1 * | 12/2016 | Zahabian | A43B 3/24 36/102 |
| 2017/0119100 | A1 | 5/2017 | Yamada | |
| 2017/0127760 | A1 | 5/2017 | Arquilla | |
| 2017/0215517 | A1 | 8/2017 | Silva | |
| 2017/0303632 | A1 * | 10/2017 | Pratt | A43B 23/088 |
| 2018/0104536 | A1 | 4/2018 | Stewart | |
| 2018/0110292 | A1 * | 4/2018 | Beers | A43B 13/28 |
| 2018/0289109 | A1 * | 10/2018 | Beers | A43B 11/00 |
| 2020/0196703 | A1 * | 6/2020 | Hopkins | A43B 23/027 |
| 2020/0205511 | A1 * | 7/2020 | Hopkins | A43B 23/088 |
| 2020/0205516 | A1 * | 7/2020 | Kilgore | A43B 3/0078 |
| 2020/0205517 | A1 * | 7/2020 | Happen | A43B 13/146 |
| 2020/0205518 | A1 * | 7/2020 | Hopkins | A43B 21/32 |
| 2020/0205520 | A1 * | 7/2020 | Kilgore | A43B 23/20 |
| 2021/0112914 | A1 * | 4/2021 | Cheney | A43B 23/027 |
| 2021/0112916 | A1 * | 4/2021 | Schulten | A43B 23/08 |

FOREIGN PATENT DOCUMENTS

| | | | |
|---|---|---|---|
| CN | 101528072 | A | 9/2009 |
| CN | 201898951 | U | 7/2011 |
| CN | 102871329 | A | 1/2013 |
| CN | 203884809 | U | 10/2014 |
| CN | 204070772 | U | 1/2015 |
| CN | 105658105 | A | 6/2016 |
| CN | 205267152 | U | 6/2016 |
| CN | 106998856 | A | 8/2017 |
| CN | 107874384 | A | 4/2018 |
| CN | 108135329 | A | 6/2018 |
| CN | 114343284 | A | 4/2022 |
| EP | 2082658 | A1 | 7/2009 |
| EP | 2647303 | A1 | 10/2013 |
| JP | 2000139502 | A | 5/2000 |
| JP | 2004344396 | A | 12/2004 |
| JP | 2010042224 | A | 2/2010 |
| KR | 20010105550 | A | 11/2001 |
| KR | 20090093548 | A | 9/2009 |
| TW | M318332 | U | 9/2007 |
| TW | 201215342 | A | 4/2012 |
| TW | M547871 | U | 9/2017 |
| WO | 0187106 | A2 | 11/2001 |

* cited by examiner

FOOTWEAR HEEL SUPPORT DEVICE

CROSS-REFERENCE TO RELATED APPLICATION

This application is a continuation of U.S. Nonprovisional application Ser. No. 16/751,508, filed Jan. 24, 2020, which claims the benefit of priority to U.S. Provisional Application No. 62/805,037 filed Feb. 13, 2019, and each of which are incorporated by reference in their entirety.

TECHNICAL FIELD

The present disclosure generally relates to an article of footwear with a heel support device configured for ease of foot entry.

BACKGROUND

Traditionally, placing footwear on a foot often requires the use of one or both hands to stretch the ankle opening of a footwear upper, and hold the rear portion during foot insertion, especially in the case of a relatively soft upper and/or an upper that does not have a heel counter secured to a flexible fabric rearward of the ankle opening.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
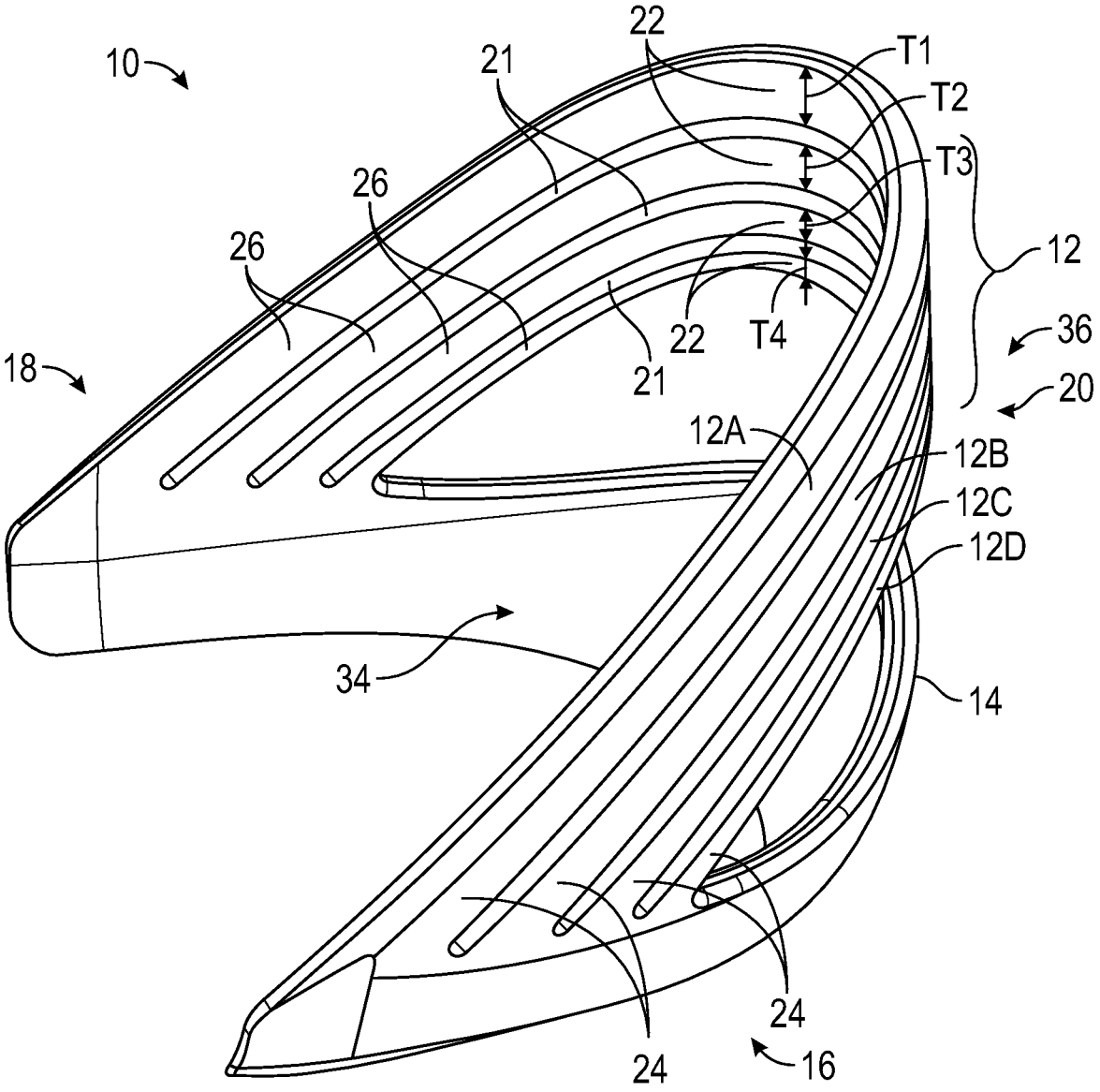
FIG. 1 is a perspective view of a heel support device.

Various heel support devices and articles of footwear having the heel support devices are disclosed herein that enable relatively easy foot entry and removal in a hands-free manner. In an example, an article of footwear may include an upper and a heel support device. The upper may define a foot-receiving cavity with a heel region. The heel support device may be disposed at a rear portion of the upper, and may extend around the rear of the heel region. For example, the heel support device may be disposed in the rear portion of the upper, secured in position at the rear portion of the upper, or both. The heel support device may include a plurality of slats and a base. Each slat may have a center segment and an arm extending downwardly and forwardly from the center segment to the base. Each slat may be resiliently bendable between an unloaded position and a loaded position when depressed toward the base from the unloaded position to the loaded position. The center segment may be spaced further apart from the base in the unloaded position than in the loaded position. The plurality of slats may include an uppermost slat, a lowermost slat closer to the base than the uppermost slat, and at least one intermediate slat disposed between the uppermost slat and the lowermost slat. The plurality of slats may include a progressive gradient of widths from the lowermost slat to the uppermost slat. Additionally, in some example heel support devices, the plurality of slats may include a progressive gradient of lengths from the lowermost slat to the uppermost slat. For example, the lowermost slat may be shorter and thinner than the at least one intermediate slat, and the at least one intermediate slat may be shorter and thinner than the uppermost slat. Each slat may be considered to act similar to a beam fixed at one end and free at the center segment when a downward load is applied to the center segment. For a given downward applied load to the center segment of such a slat, downward deflection is greater for a longer slat than for a shorter slat, and for a narrower slat than for a wider slat (e.g., where length is measured along the longitudinal center axis of the slat and thickness is measured perpendicular to the longitudinal axis of the slat), and assuming that the cross-sectional area of the narrower slat is less than the cross-sectional area of the wider slat. Accordingly, configuring the device with a plurality of slats with a progressive gradient of widths, a progressive gradient of lengths, or both, may enable each slat to tend to deflect a similar amount under a given load.

In an aspect of the disclosure, the heel support device may include a peg extending through an aperture in the upper and secured at a surface of the upper. For example, a portion of the peg extending outward of the aperture may be secured by radio-frequency welding or otherwise to an exterior surface of the upper. In some embodiments, the upper may include an inner layer and an outer layer. The aperture may extend through the outer layer. The heel support device may be disposed between the inner layer and the outer layer. In one example, the peg extends outward from the center segment of the lowermost slat of the plurality of slats, and may be the only peg extending outward from the plurality of slats. Because the lowermost one of the slats is the thinnest slat, in order to enable the peg to have a larger diameter, the center segment of the lowermost one of the slats from which the peg extends may have a thickened region from which the peg extends. In other examples, the peg may extend outward from the center segment of a different one of the slats and/or one or more additional pegs may extend outward from the rear of the base or from the sides of the base.

In another aspect of the disclosure, the center segment of one slat of the plurality of slats may include an elongated tip extending rearwardly. The elongated tip serves to increase the surface area upon which a foot may rest while applying a downward force and moving into the foot-receiving cavity of the upper. For example, the elongated tip may extend from the uppermost slat of the plurality of slats. In some implementations, the upper is configured to receive the elongated tip. For example, the upper may have a heel collar defining an opening into the foot-receiving cavity. The upper may have a tapered extension extending rearward from the heel collar. The tapered extension of the heel collar may overlay the elongated tip. The tapered extension of the heel collar may form an internal cavity, and the elongated tip may be disposed in the internal cavity of the tapered extension of the heel collar. An upper surface of the elongated tip may slope downward and inward toward the foot-receiving cavity. In some embodiments, a slope of the upper surface of the elongated tip may increase in a forward direction along a longitudinal midline of the article of footwear, providing a ramp. This may help to ease the foot into the foot-receiving cavity. In some embodiments, an outer perimeter of the center segment may have a discontinuity point at the elongated tip. Stated differently, the outer perimeter angles outward at the elongated tip. For example, there may be a discontinuity point on either side of the elongated tip. The location of the elongated tip is more easily determined from above due to the discontinuity point(s) in comparison to a center segment without a discontinuity at the outer perimeter, increasing the ease with which the heel of the foot may be aligned with and rest on the elongated tip during depression of the heel support device and insertion of the foot into the foot-receiving cavity.

In another aspect, the heel support device may be configured to enable easy and accurate securement of the upper to the heel support device during manufacturing. For example, the base of the heel support device may include a relatively thick portion adjacent an uppermost extent of the base and a relatively thin portion adjacent a lowermost extent of the base. The upper may be sewn or adhered to the relatively thin portion of the base. Due to its relative thinness, a sewing needle may more easily penetrate the relatively thin portion during sewing of the upper to the heel support device. Additionally, the bounds of the relatively thin portion may be readily apparent due to the contrast with the thicker portion of the base, facilitating accurate alignment and placement of the upper against the relatively thin portion during stitching or adhering processes.

In a configuration, an article of footwear may include an upper and a heel support device. The upper may define a foot-receiving cavity with a heel region, the upper may have a heel collar defining an opening into the foot-receiving cavity, and the upper may have a tapered extension extending rearward from the heel collar. The heel support device may extend around a rear of a heel region and may include a control bar and a base. The control bar may have a center segment and an arm extending downwardly and forwardly from the center segment to the base. The control bar may be resiliently bendable between an unloaded position and a loaded position, and may be depressible toward the base from the unloaded position to the loaded position. The center segment may be spaced further apart from the base in the unloaded position than in the loaded position. The center segment may include an elongated tip extending rearwardly. The tapered extension of the heel collar may overlay the elongated tip. The tapered extension of the heel collar may form an internal cavity, and the elongated tip may be disposed in the internal cavity of the tapered extension of the heel collar. For example, the tapered extension may be configured, shaped, and dimensioned so that the internal cavity closely matches the shape and dimensions of the elongated tip, the tapered extension serving as a pocket that helps to closely fit the upper around the elongated tip of the heel support device.

In a configuration, an article of footwear may include an upper and a heel support device. The upper may define a foot-receiving cavity with a heel region, and the upper may have a heel collar defining an opening into the foot-receiving cavity. The heel support device may extend around a rear of a heel region and may include a control bar and a base. The control bar may have a center segment and an arm extending downwardly and forwardly from the center segment to the base. The control bar may be resiliently bendable between an unloaded position and a loaded position, and may be depressible toward the base from the unloaded position to the loaded position. The center segment may be spaced further apart from the base in the unloaded position than in the loaded position. The center segment may include an elongated tip extending rearwardly. The upper may overlay at least one of the arm and the elongated tip. In some implementations, the upper may overlay each of the arm and the elongated tip.

Referring to the drawings, wherein like reference numbers refer to like components throughout the views, embodiments of heel support devices are depicted with various features advantageous for promoting foot entry into an article of footwear potentially in a hands-free manner. FIG. 1 shows a heel support device 10 that includes a plurality of slats 12 and a base 14. The slats 12 may also be referred to collectively herein as a control bar. In some embodiments of heel support devices disclosed herein, there may be only a single slat that may be referred to as a control bar. The device 10 is shown as an integral, unitary, one-piece component, with each slat of the plurality of slats 12 as well as the base 14 configured as a continuous arc extending around a rear 20 of the device 10 from a medial side 16 to a lateral side 18.

The material of the device 10 is selected to provide the ability to elastically deform by elastic bending to a loaded or access position, as described, and store potential energy, such as elastic energy, that returns the device 10 to an unstressed position (referred to as an unloaded position, unstressed position, or use position). Example materials for the device 10 include plastics (such as thermoplastics), composites, and nylon. An example material for the device 10 is a polyether block amide such as PEBAX® available from Arkema, Inc. in King of Prussia, Pa. USA. Another example material for the device 10 is a fiberglass reinforced polyamide. An example fiberglass reinforced polyamide is RISLAN® BZM 7 0 TL available from Arkema, Inc. in King of Prussia, Pa. USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity). Another example material for the device 10 is Nylon 12 (with or without glass fiber), such as RTP 200F or RTP 201F available from RTP Company of Winona, Minn. USA. Another example material for the device 10 is rigid thermoplastic polyurethane (with or without glass fiber), such as RTP 2300 or RTP 2301 available from RTP Company of Winona, Minn. USA. Still another example material for the device is Acetal (Polyoxymethylene (POM)) (with or without glass fiber), such as RTP 800 or RTP 801 available from RTP Company of Winona, Minn. USA. The materials specifically named above are intended only as examples, not as an exclusive listing, and in combination with the entire provided description, inform an ordinarily skilled artisan regarding alternative materials having similar properties that may be useful when formed according to one or more of the structural embodiments disclosed herein.

As shown in FIG. 1, the plurality of slats 12 includes a total of four slats, including an uppermost slat 12A, a first intermediate slat 12B, a second intermediate slat 12C, and a lowermost slat 12D. The first intermediate slat 12B is disposed between the uppermost slat 12A and the second intermediate slat 12C. The second intermediate slat 12C is disposed between the first intermediate slat 12B and the lowermost slat 12D. Within the scope of the disclosure, the plurality of slats 12 could include only one of the intermediate slats 12B or 12C, for a total of three slats, or could include more than two intermediate slats for a total of more than four slats.

Each slat 12A-12D has a center segment 22, a medial arm 24 extending downwardly and forwardly from the center segment 22 to the base 14, and a lateral arm 26 extending downwardly and forwardly from the center segment 22 to the base 14. In some embodiments disclosed herein with only a single slat or a plurality of slats, each slat may include only a medial arm or only a lateral arm extending from the center segment to the base. Lower ends of the medial and lateral arms 24, 26 are integrally formed with the base 14 so that the arms 24, 26 function as resiliently bendable junctions near their connection to the base 14, as described herein. When in the unloaded position shown in FIG. 1 (also referred to as the use position) adjacent slats are separated from one another by slots 21 (e.g., air gaps).

The center segment 22D of the lowermost slat 12D is disposed closer to the base 14 than the center segment 22A of the uppermost slat 12A and also closer to the base 14 than the center segments 22B and 22C of the first and second intermediate slats 12B and 12C, respectively. As further discussed herein, when the plurality of slats 12 is depressed downward toward the base 14 by a force such as the force of a foot entering an article of footwear, each of the slats elastically bends toward the base 14, and adjacent slats 12 may come into contact with one another at the center segments 22. When in the loaded position shown in FIG. 9, the slots 21 close and adjacent slats 12 contact one another at the center segments 22.

The plurality of slats 12 includes a progressive gradient of widths and lengths from the lowermost slat 12D to the uppermost slat 12A. Stated differently, and with reference to FIGS. 1 and 2, and the thicknesses and lengths of the slats 12 increase in order of progression of the slats 12 from the lowermost slat 12D to the uppermost slat 12A. The lowermost slat 12D has the smallest thickness T4 and the shortest length L4. The second intermediate slat 12C has a thickness T3 greater than thickness T4 and a length L3 greater than length L4. The first intermediate slat 12B has a thickness T2 greater than thickness T3 and a length L2 greater than length L3. The uppermost slat 12A has a thickness T1 greater than thickness T2 and a length L1 greater than length L2. In one non-limiting example, the thickness T1 may be 5 mm, thickness T2 may be 4.5 mm, thickness T3 may be 4 mm, and the thickness T4 may be 2.5 mm. In non-limiting examples, ranges of widths of the slats may be between 1.5 mm to 6.5 mm in the order of progression discussed. Because the bending moment of a beam-like object (such as any of the slats 12A, 12B, 12D, and 12D) is proportional to its thickness and its length (e.g., where thickness is measured perpendicular to a longitudinal axis of the slat and length is measured along the longitudinal axis of the slat), configuring the device 10 with a plurality of slats 12 enables bending at a lower force than if a single, thicker slat were used that had a thickness extending from the top of the uppermost slat 12A to the bottom of the lowermost slat 12D. Each slat 12A, 12B, 12C, and 12D bends under an applied load (e.g., force F in FIG. 9), deflecting in proportion to its individual thickness and length (where thicker slats deflect less under a given load than a thinner slat of the same length, and longer slats deflect more under a given load than a shorter slat of the same thickness). Accordingly, each slat deflects a given amount under a lesser force than would the single slat of greater overall thickness. The slats 12A, 12B, 12C, and 12D contact one another at the center segments 22 when a downward load is applied to the uppermost slat 12A. However, the slats 12A, 12B, 12C, and 12D slide against one another where they contact so that bending force requirements for a desired amount of deflection do not increase to that of the single wide slat example (e.g., they each act as a separate beam rather than one large beam).

Figure 2:
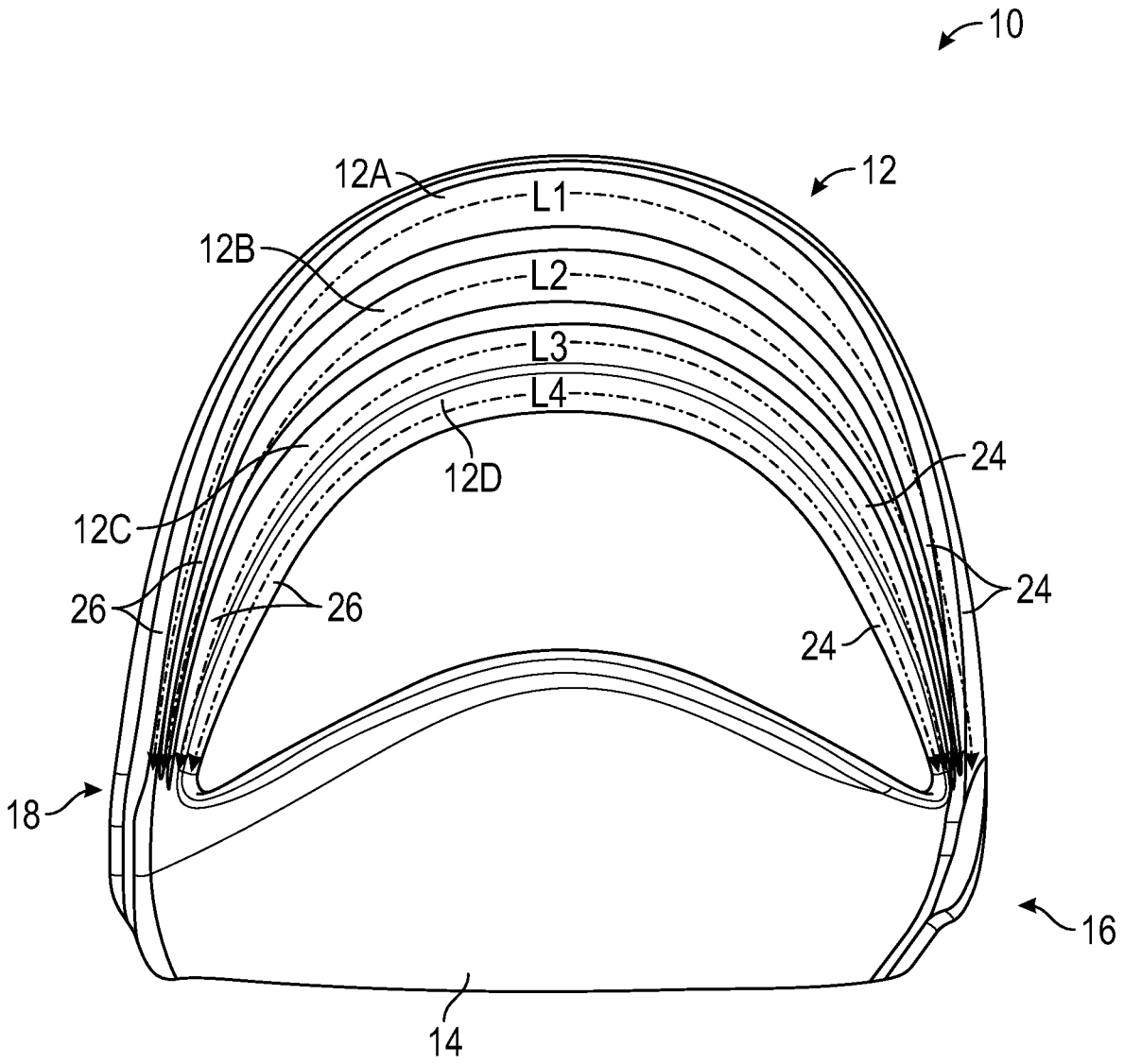
FIG. 2 is a front view of the heel support device of FIG. 1.

As is apparent in FIG. 2, the slats 12A, 12B, 12C, and 12D increase in length from the lowermost slat 12D to the uppermost slat 12A, where length is measured from the end of the respective medial arm 24 at the base 14 to the end of the respective lateral arm 26 at the base 14. The lowermost slat 12D is shorter than the adjacent intermediate slat 12C because the lowermost slat 12D is closer to the base 14 and its ends are rearward of the ends of the adjacent intermediate slat 12C yet the center segments 22 are relatively vertically stacked. Likewise, the second intermediate slat 12C is shorter than the intermediate slat 12B, and the first intermediate slat 12B is shorter than the uppermost slat 12A. Accordingly, the lowermost slat 12D is shorter and thinner than the intermediate slat 12C, which is shorter and thinner than the intermediate slat 12B, which is shorter and thinner than the uppermost slat 12A.

Figure 3:
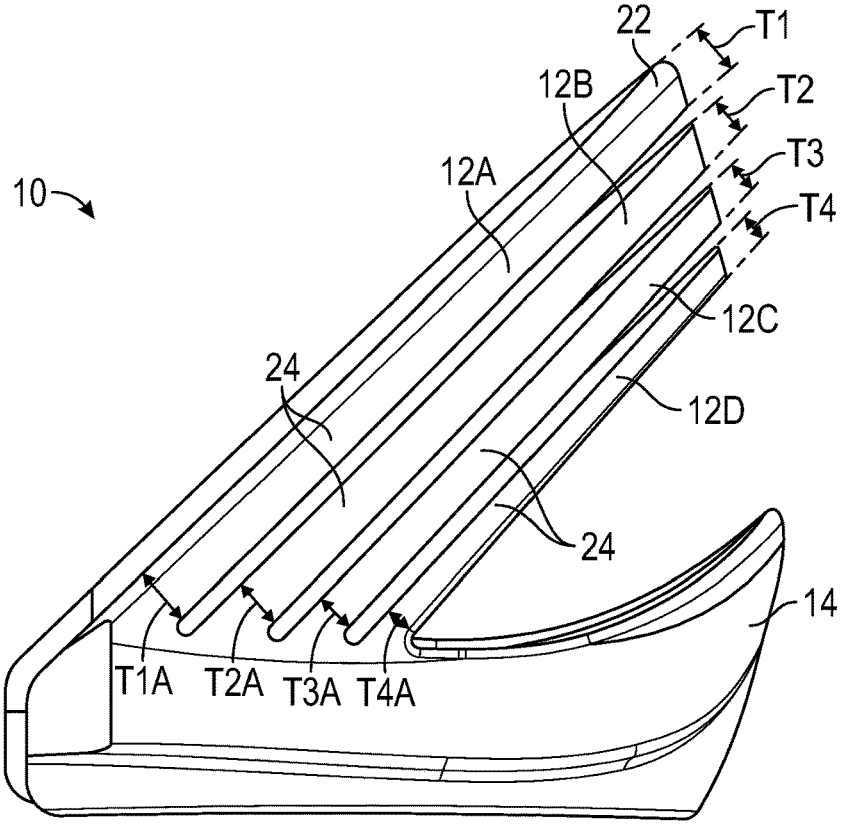
FIG. 3 is a medial side view of the heel support device of FIG. 1.
Figure 4:
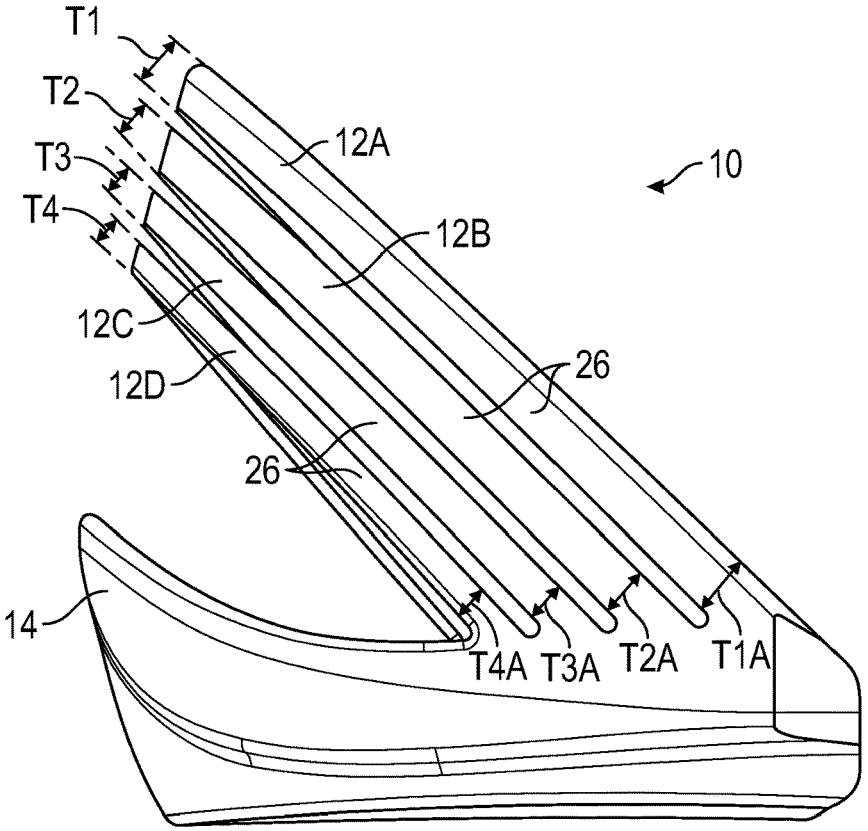
FIG. 4 is a lateral side view of the heel support device of FIG. 1.

As best shown in FIGS. 3 and 4, each slat is thicker at an end of its respective medial arm 24 (FIG. 3) and at an end of its respective lateral arm 26 (FIG. 4) (e.g., near the base 14) than at the center segment 22. Stated differently, each slat varies in thickness along its length with a minimum thickness at the center segment 22 and a maximum thickness at the ends of the medial arm 24 and the lateral arm 26. Additionally, the cross-sectional area of each of the medial arm 24 and the lateral arm 26 at the ends is greater than the cross-sectional area of the center segment 22 where each cross-section is taken perpendicular to the length (e.g., to the longitudinal center axis) of the respective slat 12A, 12B, 12C, or 12D. The uppermost slat 12A has a thickness T1A at its ends greater than thickness T1. For example, thickness T1A may be 1 mm greater than thickness T1. The intermediate slat 12B has a thickness T2A at its ends greater than the thickness T2. For example, thickness T2A may be 1 mm greater than thickness T2. The intermediate slat 12C has a thickness T3A at its ends greater than the thickness T3. For example, thickness T3A may be 1 mm greater than thickness T3. The lowermost slat 12D has a thickness T4A at its ends greater than the thickness T4. For example, thickness T4A may be 1 mm greater than thickness T4. Additionally, the thicknesses at the ends increase in the order T4A, T3A, T2A, T1A, with T4A being the thinnest and T1A being the thickest. Because portions of the medial arms 24 and the lateral arms 26 closest to the base 14 undergo the most drastic bending when the center segments 22 are depressed to the access position (shown in FIG. 9), by making these portions thicker than the center segment 22 (and with a corresponding greater cross-sectional area than the center segment) the stress in these portions is reduced in comparison to a thinner arm.

Figure 5:
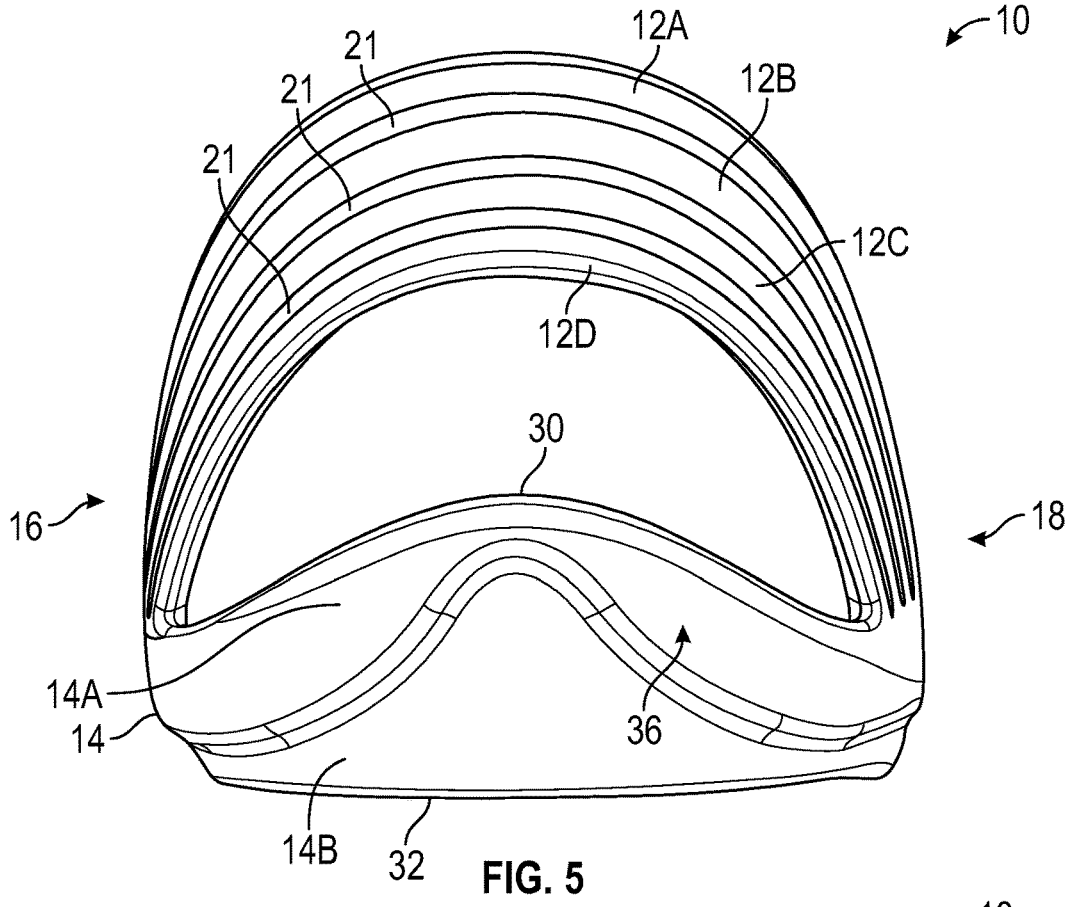
FIG. 5 is a rear view of the heel support device of FIG. 1.
Figure 6:
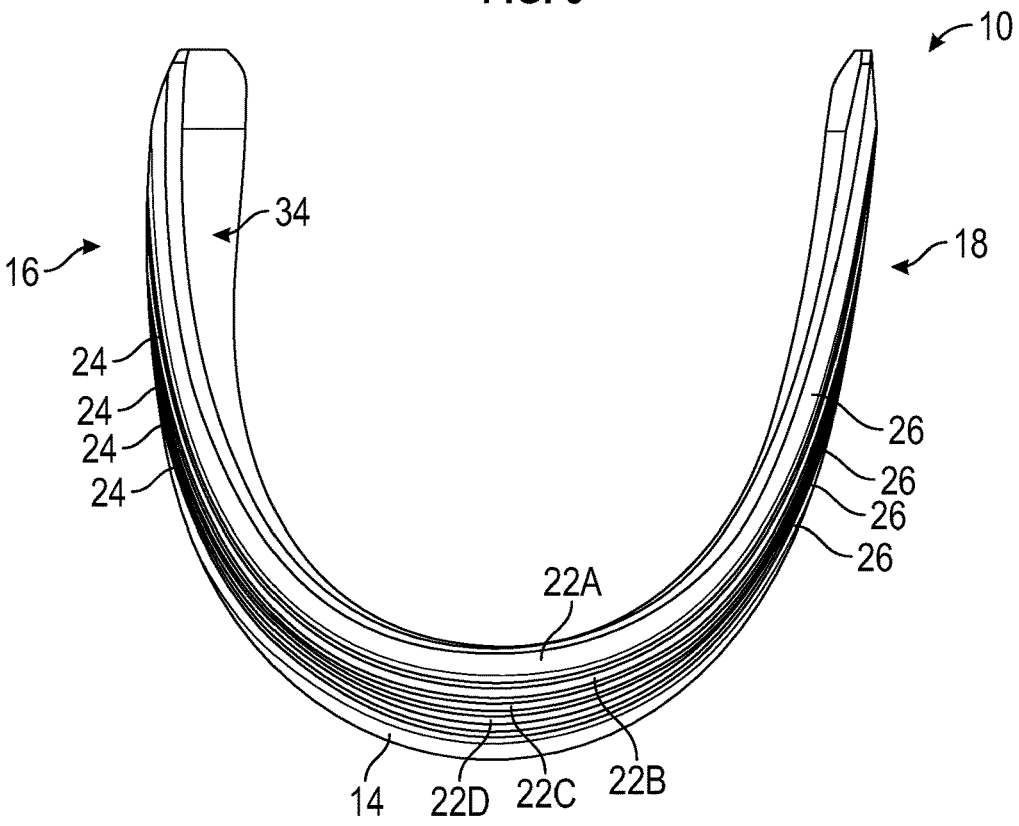
FIG. 6 is a top view of the heel support device of FIG. 1.
Figure 7:
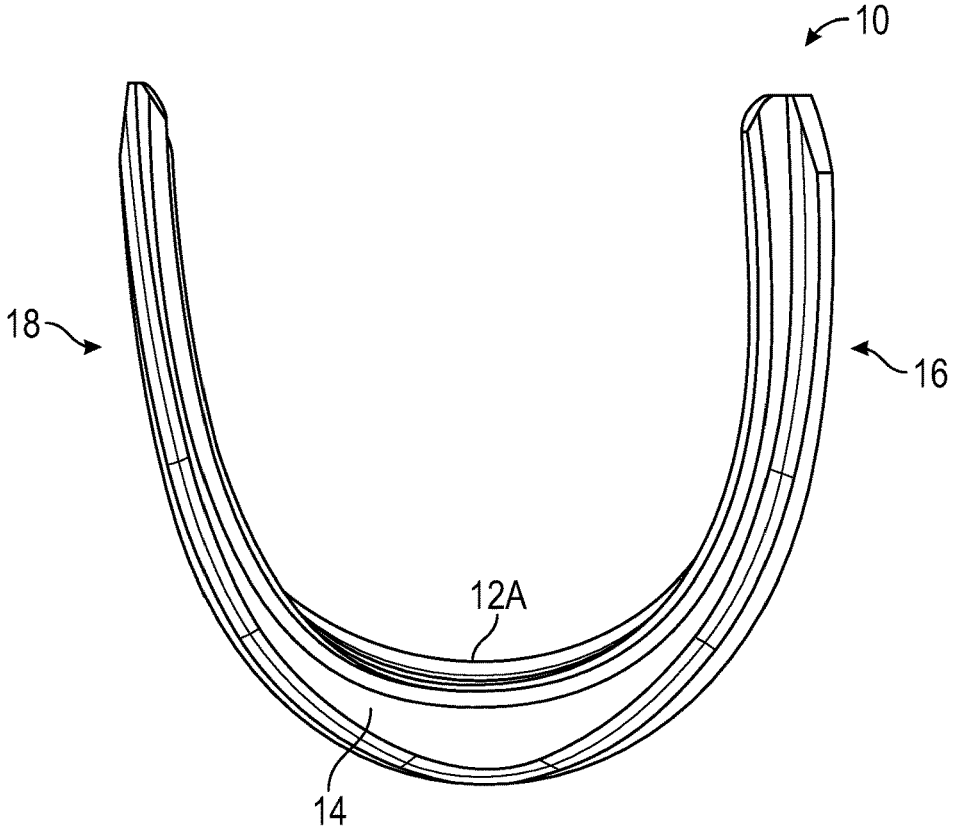
FIG. 7 is a bottom view of the heel support device of FIG. 1.

FIG. 5 is a rear view of the heel support device 10. It is apparent from the views of the heel support device 10 that the base 14 includes a relatively thick portion 14A adjacent an uppermost extent 30 of the base 14, and a relatively thin portion 14B adjacent a lowermost extent 32 of the base 14. The relatively thin portion 14B is sufficiently thin to allow the device 10 to be secured to a footwear upper by sewing (e.g., stitching) a lower extent of the upper to the base 14 through the relatively thin portion 14B. Alternatively or in addition, the base 14 may be adhered to the upper. In some configurations, the base 14 may be sewn and/or adhered to a sole structure underlying the footwear upper, such as to a midsole. Because the relatively thin portion 14B is outward of the sole of the foot and nearer to the sole of the foot than the relatively thick portion 14A when a heel support having the base 14 with the relatively thick portion 14A and the relatively thin portion 14B (such as the heel support device 110) is secured in an upper 42 of an article of footwear 14B as in FIG. 14, it may provide greater comfort due to its greater flexibility than the relatively thick portion. In various embodiments, the device may be disposed at or in a rear portion of the upper. In some embodiments, the device 10 may be secured to the upper at an exterior surface of an outermost layer of the upper. For example, an inner side 34 (shown in FIGS. 1 and 6) of the device 10 may be disposed at an exterior surface of an outer layer of the upper. Alternatively, the device 10 may be disposed between layers of the upper (e.g., in the upper) so that it is mostly or completely covered and not viewable from the exterior of the footwear, with the inner side 34 of the device 10 secured to an outer surface of an inner layer of the upper, and an outer layer of the upper outward of an outer side 36 of the device 10 (shown in FIGS. 1 and 5). FIG. 7 is a bottom view of the device 10.

Figure 8:
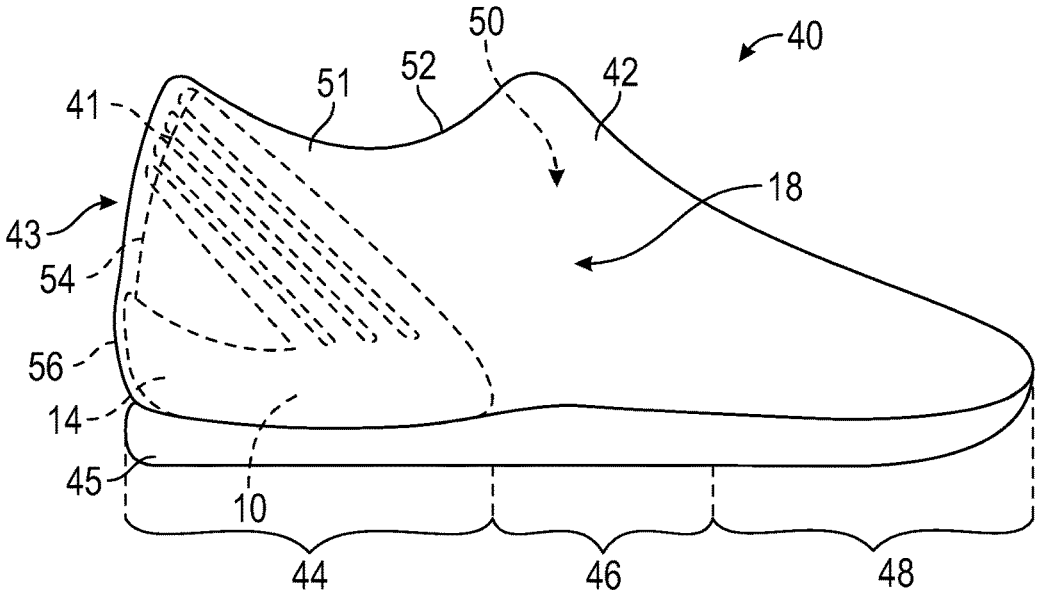
FIG. 8 is a lateral side view of an article of footwear with the heel support device of FIG. 1 in a use position.

FIG. 8 shows an article of footwear 40 with the heel support device 10 in an unloaded position, also referred to as the use position. The heel support device 10 is secured to a rear 41 of an inner layer 54 of a footwear upper 42, and extends around the rear 43 of a heel region 44 of the article of footwear 40 from the lateral side 18 (shown) to a medial side at which the medial side 16 of the device 10 is disposed. The article of footwear 40 also includes a midfoot region 46 and a forefoot region 48. The device 10 and the upper 42 are secured to an underlying sole structure 45. The upper 42 extends in the heel region 44, the midfoot region 46, and the forefoot region 48 and forms a foot-receiving cavity 50 over the sole structure 45. The upper 42 has a heel collar 51 and an ankle opening 52 at the heel collar 51 that is in communication with the foot-receiving cavity 50 and through which a foot 60 (see FIG. 9) may be inserted. The heel support device 10 is shown in hidden lines as it is disposed between the inner layer 54 (represented with hidden lines) and the outer layer 56 of the upper 42. Alternatively, the device 10 may be secured to an exterior of the outer layer 56 such that it is viewable on the footwear 40 (e.g., from the exterior of the footwear) in some embodiments.

Figure 9:
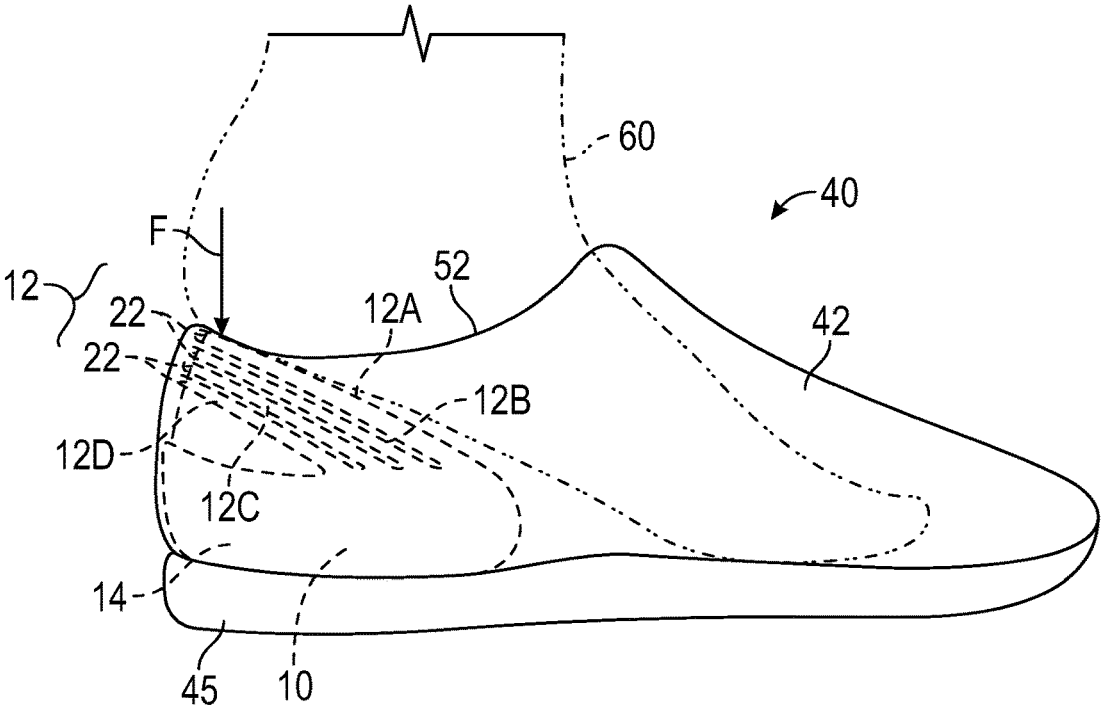
FIG. 9 is a lateral side view of the article of footwear of FIG. 8 with the heel support device in an access position.

As shown in FIG. 9, the plurality of slats 12 is depressible under an applied force F from the unloaded position of FIG. 8 to a loaded position of FIG. 9, also referred to as an access position. Under the applied force F of the foot 60 on the uppermost slat 12A at the center segment 22 (e.g., through the upper 42), the slats 12A-12D depress so that the center segments 22 are closer to the base 14 than in the unloaded position. The upper 42 is pulled downward by the device 10 at the rear of the ankle opening 52 so that the ankle opening 52 opens to a greater extent (e.g., from above and from the rear) than in the use position, allowing the foot 60 to more easily enter into the foot-receiving cavity 50. For example, the use of hands or other tools to stretch or open the ankle opening 52 may be avoided. If the upper 42 is of a stretchable material, the ankle opening 52 may be larger in the access position than in the use position. Each slat 12A-12D resiliently bends between the unloaded position of FIG. 8 and the loaded position of FIG. 9 when the plurality of slats 12 is depressed toward the base 14. When the foot 60 completes entry, the internal biasing forces of the slats 12A-12D will return the device 10 to the unloaded position, releasing the stored energy input by the foot 60 to bend the slats 12A-12D. The device 10 and the rear of the upper 42 will slip upward over the rear of the heel portion of the foot 60 in returning to the unloaded position.

Figure 10:
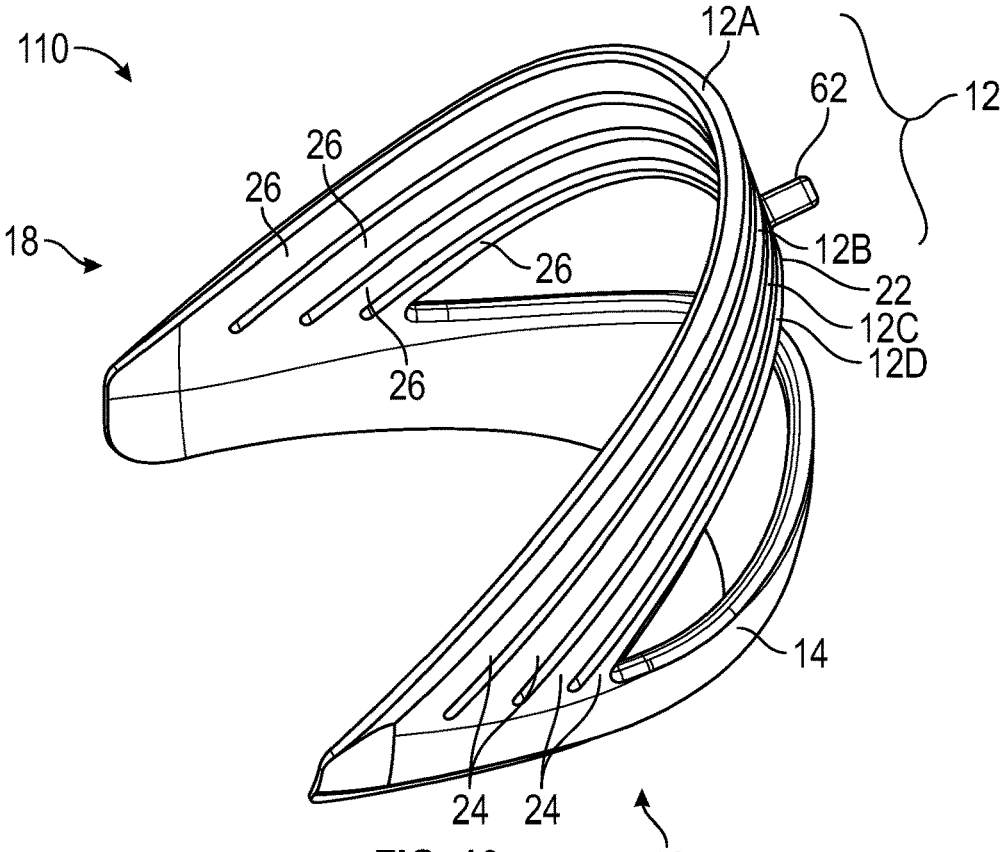
FIG. 10 is a perspective view of another heel support device.
Figure 11:
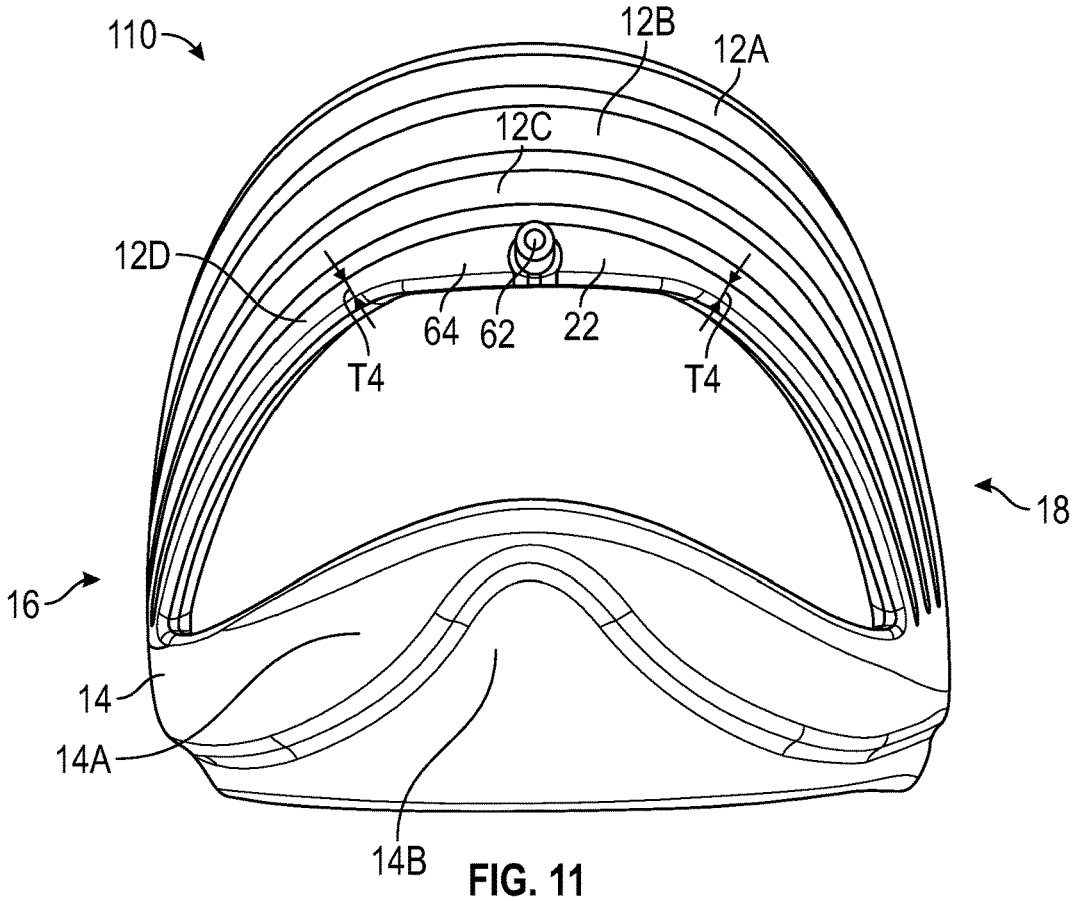
FIG. 11 is a rear view of the heel support device of FIG. 10.
Figure 12:
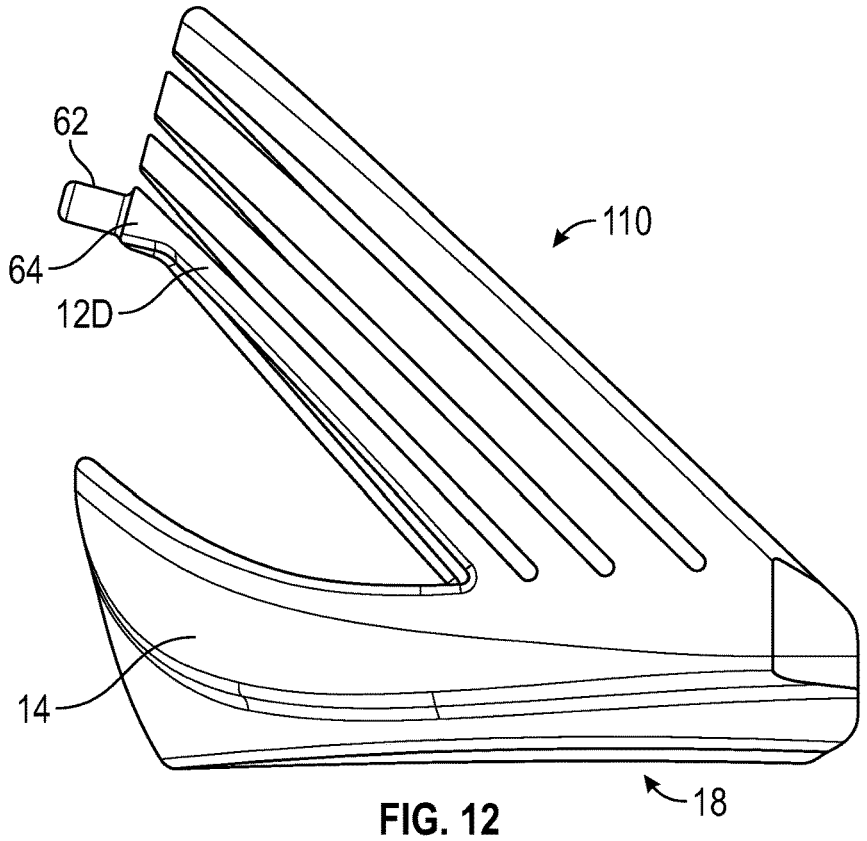
FIG. 12 is a lateral side view of the heel support device of FIG. 10.
Figure 13:
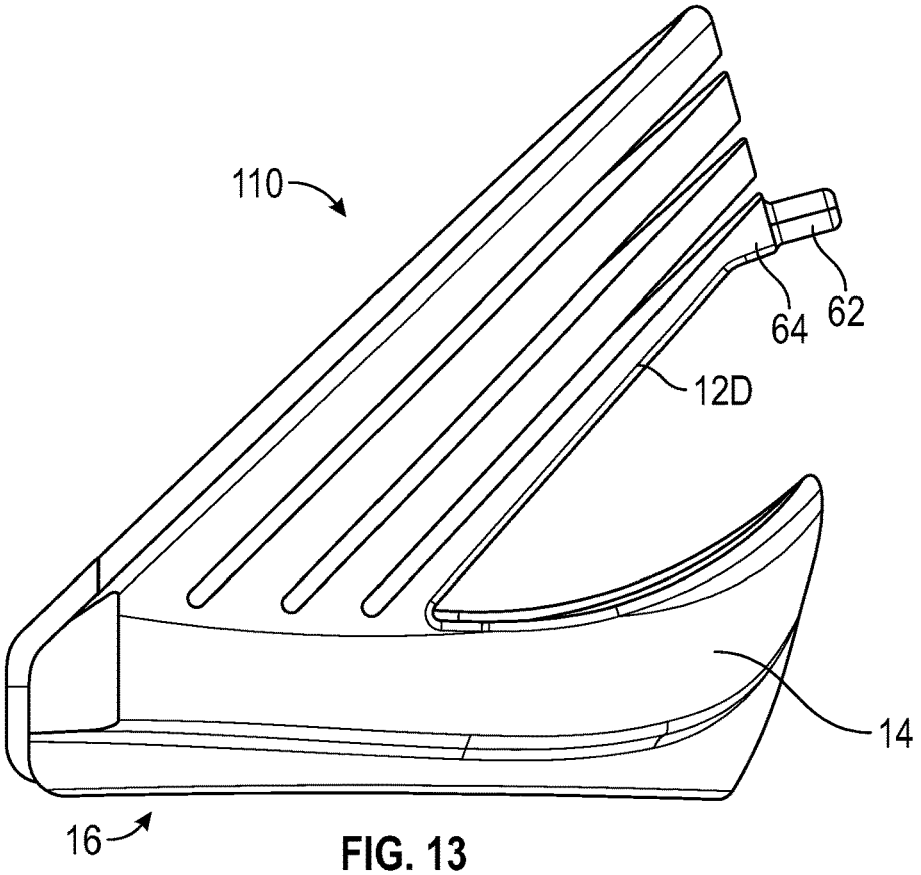
FIG. 13 is a medial side view of the heel support device of FIG. 10.

In some embodiments, the heel support device may include at least one peg extending through an aperture in the upper and secured at a surface of the upper. For example, referring to FIG. 10, a heel support device 110 is shown that is alike in all aspects to heel support device 10, except that the heel support device 110 includes only a single peg 62 that extends from the center segment 22 of the lowermost slat 12D. FIG. 11 best shows the position of the single peg 62 on the lowermost slat 12D. A portion of the center segment 22 of the lowermost slat 12D has a thickened region 64 from which the peg 62 extends. The thickened region 64 enables the use of a peg 62 of larger diameter than would be possible if the portion of the lowermost slat 12D from which the peg 62 extends were as thin as adjoining portions of the center segment 22 of the lowermost slat 12D. For example, whereas the adjoining portions may have a thickness T4 of about 2.5 mm, the thickened region 64 may allow the peg 62 to have a 4 mm diameter. FIGS. 12 and 13 show lateral and medial side views of the device 110.

Figure 14:
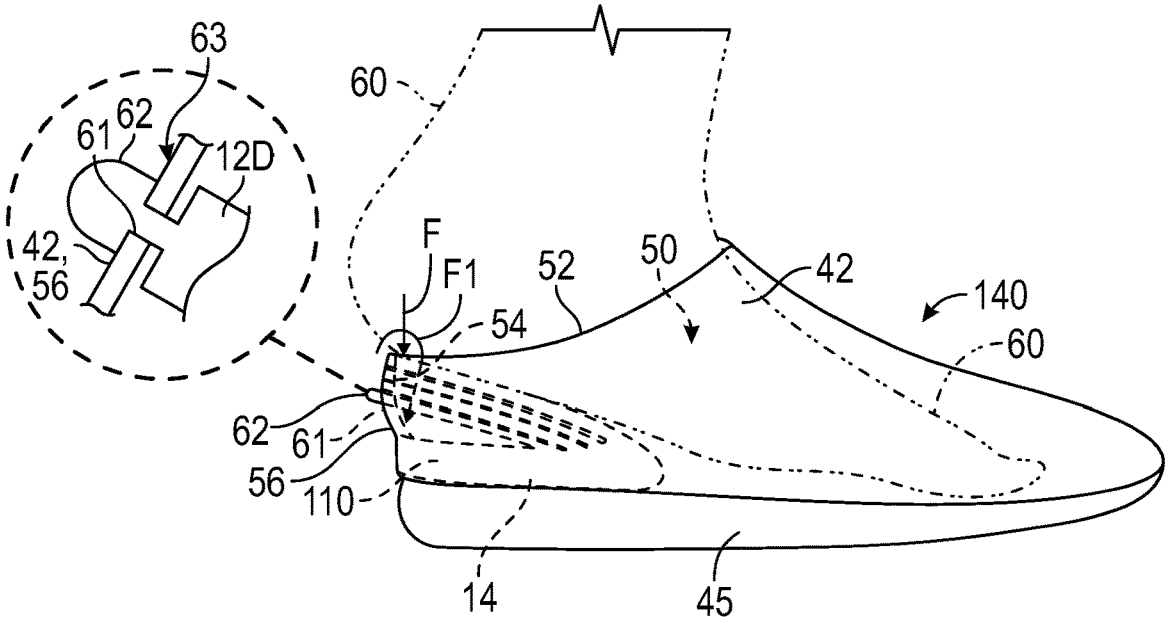
FIG. 14 is a lateral side view of an article of footwear with the heel support device of FIG. 10 in an access position.
Figure 15:
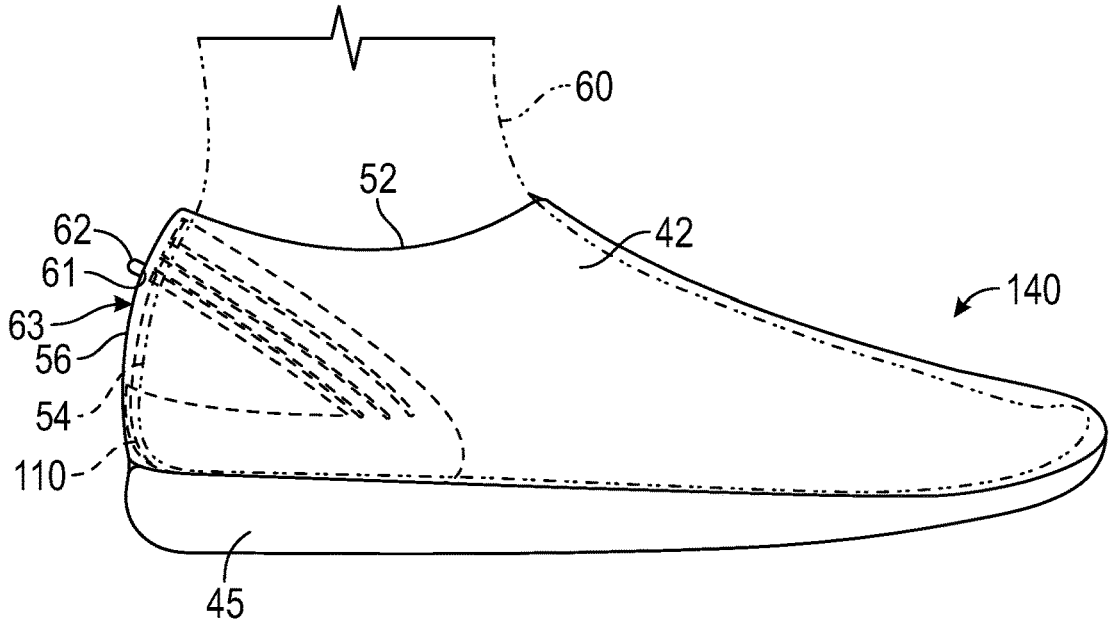
FIG. 15 is a lateral side view of the article of footwear of FIG. 14 with the heel support device in a use position.

FIGS. 14 and 15 show the device 110 when installed in the upper 42 of an article of footwear 140. The peg 62 extends through an aperture 61 of the upper 42 and is welded (e.g., by radio-frequency welding) to the outer surface 63 of the upper 42. Construction of the peg 62 as well as the method of manufacturing the footwear 140 to weld the peg 62 to the upper 42 is as described in commonly-owned, co-pending U.S. application Ser. No. 16/689,590, filed Nov. 20, 2019 which is incorporated by reference in its entirety. The aperture 61 extends through the outer layer 56 and is covered by an enlarged head of the peg 62 that is formed when the peg 62 partially melts to weld to the outer surface 63 of the upper 42. Because the peg 62 extends from the lowermost slat 12D, it anchors the outer layer 56 of the upper 42 to the lowermost slat 12D when it welds thereto. The outer layer 56 and the inner layer 54 are joined to one another at the ankle opening 52 above the device 110, such as with stitching at an inverted seam.

When the device 110 is depressed under the force F of the foot 60 as shown in FIG. 14 (e.g., under the applied load of the foot 60), the foot 60 provides a downward pull on the inner layer 54 as the foot 60 contacts and slides against the inner layer 54 during foot entry. Because the peg 62 acts as an anchor point of the outer layer 56 at the center of the lowermost slat 12D, and because the inner layer 54 is secured to the outer layer 56, the inward pull of the sliding foot 60 on the inner layer 54 is transmitted to the peg 62, and the portion of the outer layer 56 extending between the peg 62 and the inner layer 54 is pulled in a direction over the top of the uppermost slat 12A and downward with the inner layer 54, as indicated in FIG. 14 by arrow F1. Because the slats 12A-12D slide against one another in the fore-aft direction during depression of the device 10 by the force F once the slots 21 close, the pull of the upper 42 from the lowermost peg 62 up and over to the inner layer 54 helps to keep all of the slats 12A-12D moving as a unit with little or no side-to-side tipping relative to one another. In comparison, if the peg 62 were still the only peg on the device 110 but extended from the intermediate slat 12C (or any one of the slats 12A or 12B) rather than the lowermost slat 12D, then the lowermost slat 12D may not be subjected to the pulling forces of the upper 42 generated by the foot 60 because it would be below the anchor point of the upper 42 at the peg 62. This would make the slat 12D more susceptible to side-to-side movement relative to the other slats 12A, 12B, and 12C during depression and foot entry in such an embodiment.

Figure 16:
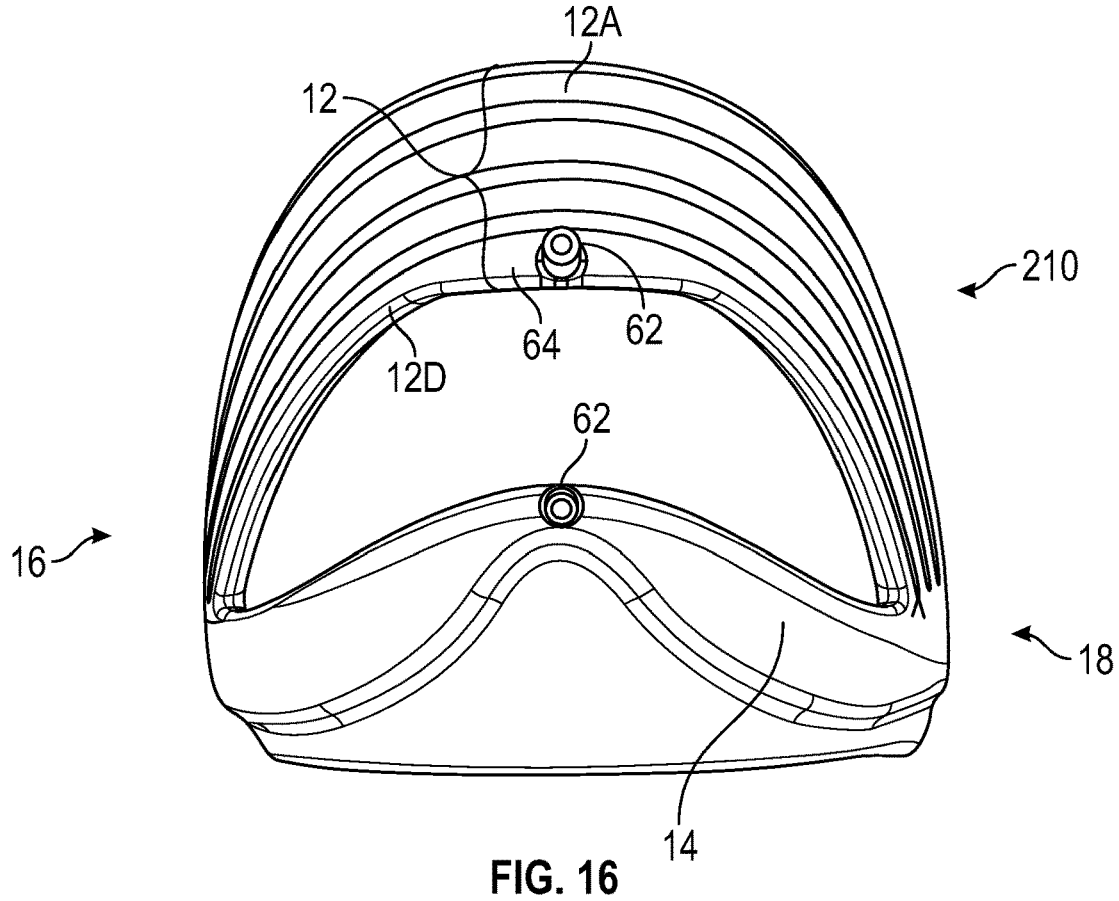
FIG. 16 is a rear view of another heel support device.
Figure 17:
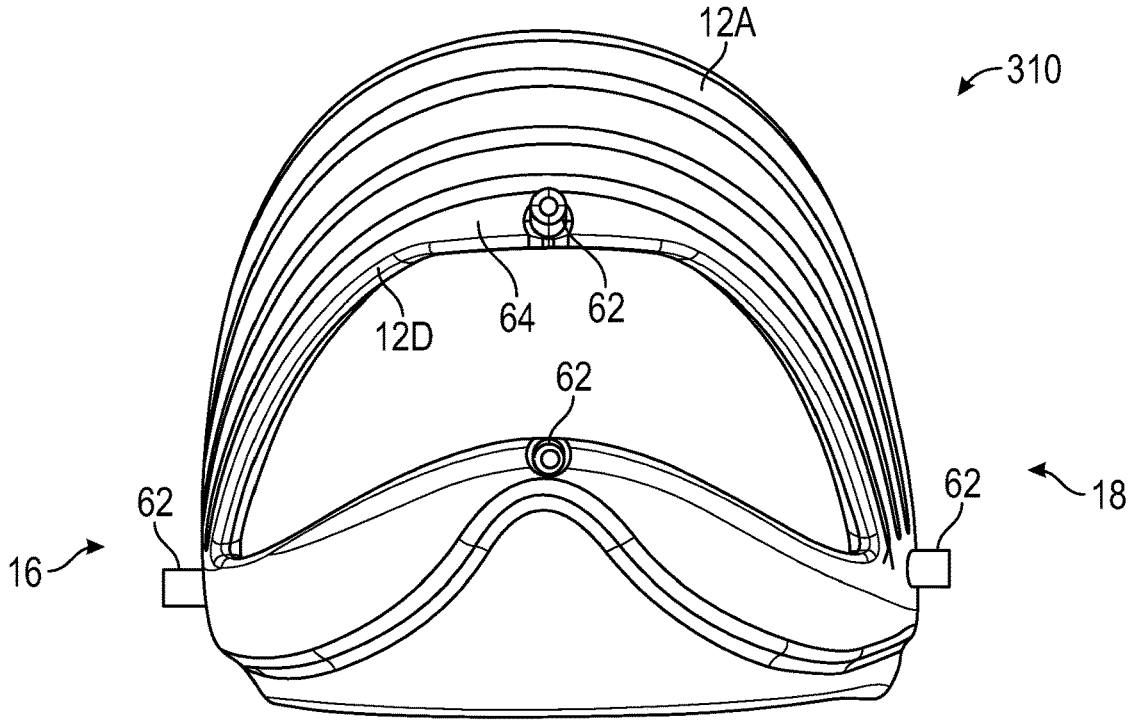
FIG. 17 is a rear view of another heel support device.

In other embodiments, there may be two or more pegs 62 extending from the heel support device. Providing at least two spaced pegs 62 extending from a heel support device like those shown and described herein enables accurate positioning of the heel support device relative to a footwear upper during manufacturing where the footwear upper is configured with the same number of apertures arranged with the same relative spacing as the multiple pegs 62. For example, FIG. 16 shows an embodiment of a heel support device 210 that is alike in all aspects to heel support device 110 except that an additional peg 62 extends outward from the rear of the base 14. When this lower peg 62 is extended through a corresponding aperture in the upper 42 and welded to the outer surface 63 of the outer layer 56, it helps to secure the outer layer 56 of the upper 42 to the base 14 in addition to any stitching or adhering of the upper to the base 14. FIG. 17 shows an embodiment of a heel support device 310 that is alike in all aspects to heel support device 110 except that three additional pegs are added for a total or four pegs 62. In addition to the peg 62 that extends from the lowermost slat 12D and the peg 62 that extends from the rear of the base 14, a peg 62 extends from the base 14 at the medial side 16, and a peg 62 extends from the base 14 at the lateral side 18. By providing four pegs 62 with one peg 62 on the lowermost slat 12D, one peg 62 on the rear of the base 14, one peg 62 on the medial side of the base 14, and one peg 62 on the lateral side 18 of the base 14, the four pegs 62 are spaced in a first arrangement of four spaced locations not all of which are coplanar. This may allow the device 310 to be more accurately positioned relative to an upper having four apertures spaced in the same first arrangement, or more accurately positioned relative to such an upper during manufacturing in a shorter period of time than would a device with only two or three pegs.

Figure 18:
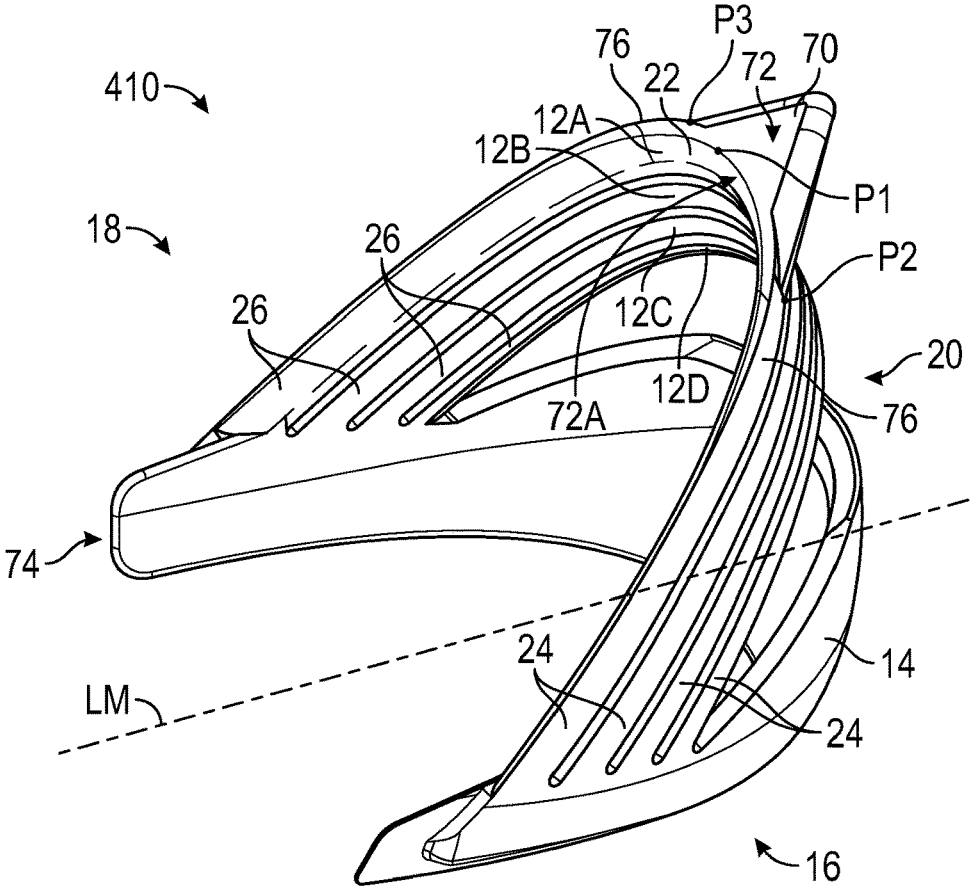
FIG. 18 is a perspective view of another heel support device.
Figure 20:
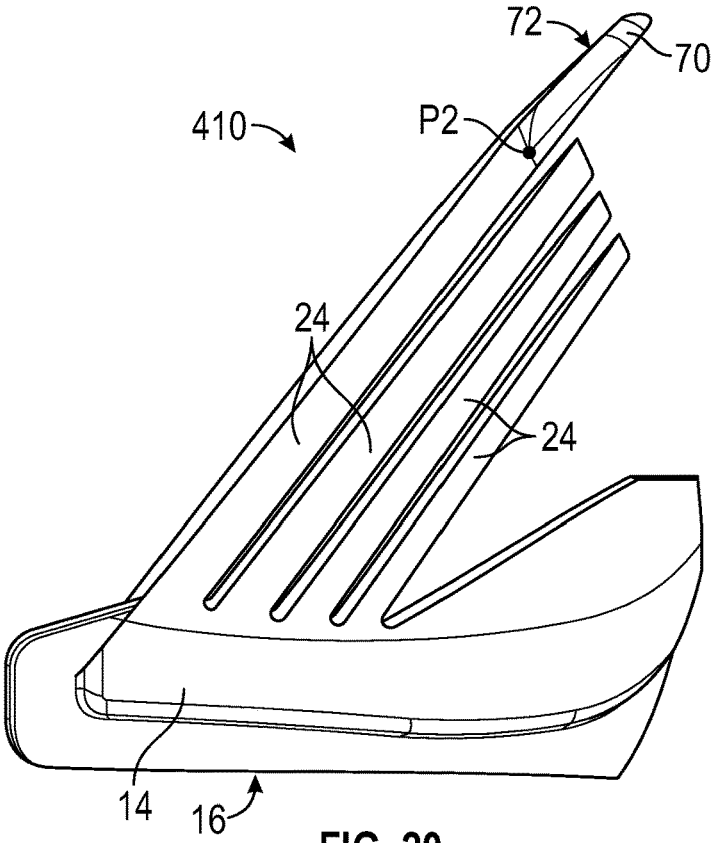
FIG. 20 is a medial side view of the heel support device of FIG. 18.
Figure 21:
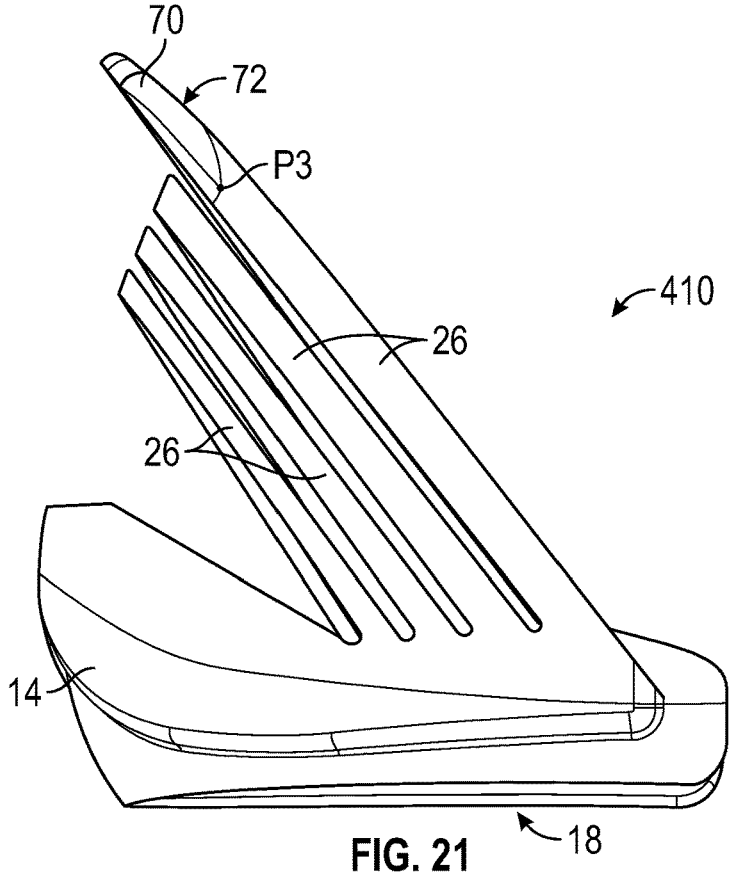
FIG. 21 is a lateral side view of the heel support device of FIG. 18.
Figure 23:
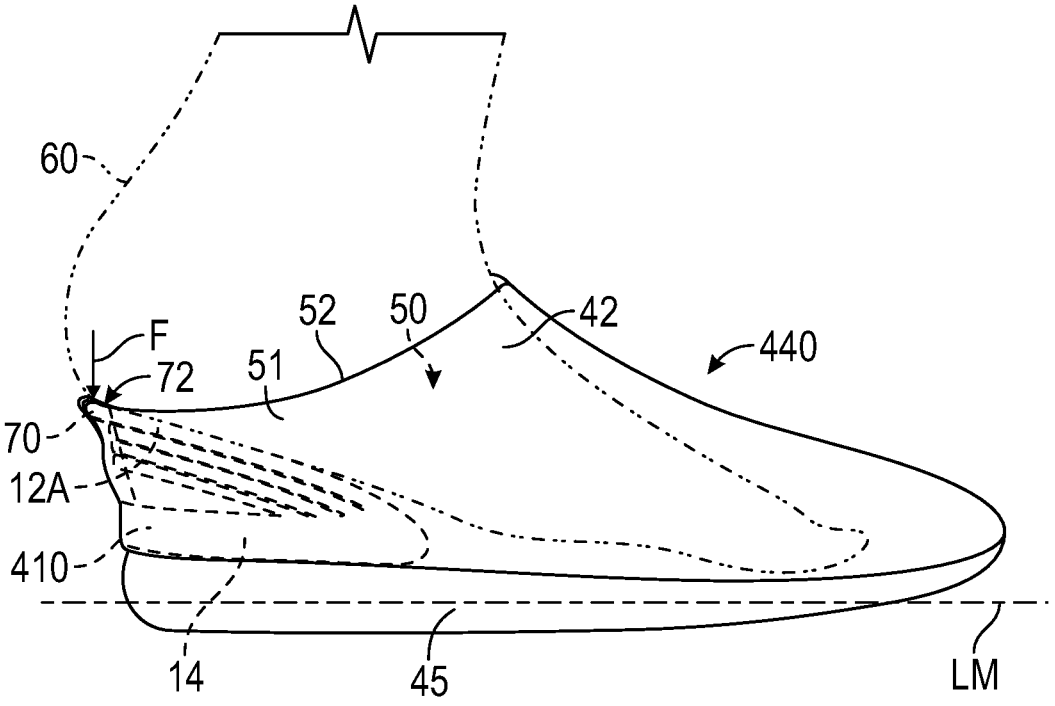
FIG. 23 is a lateral side view of an article of footwear with the heel support device of FIG. 18 in an access position.
Figure 24:
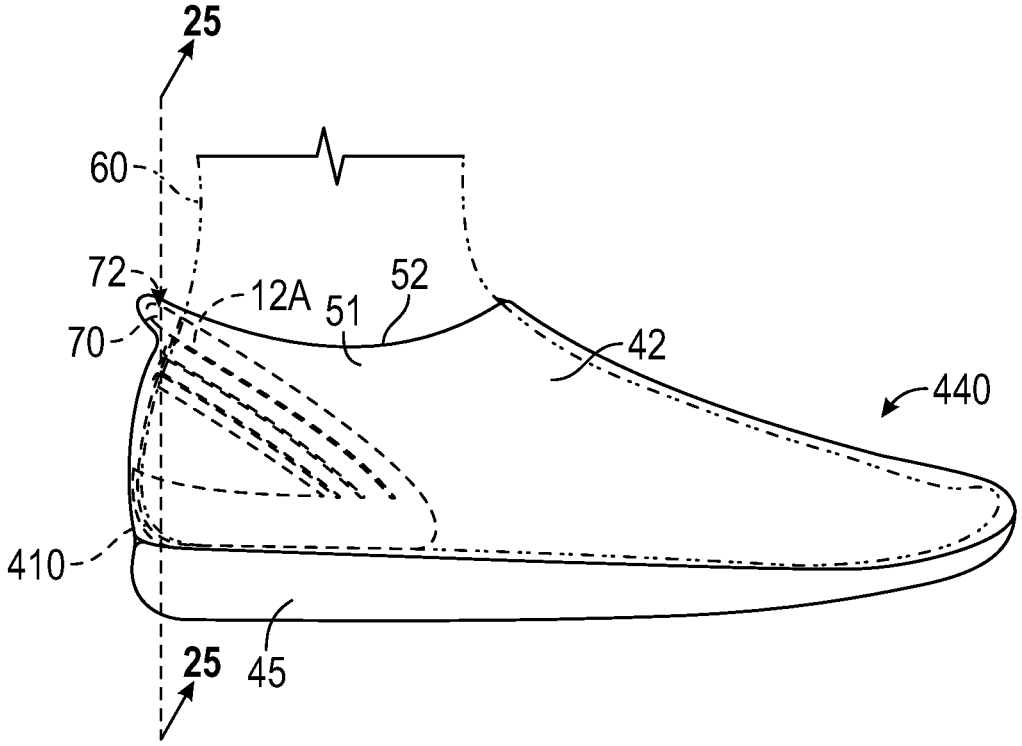
FIG. 24 is a lateral side view of the article of footwear of FIG. 23 with the heel support device in a use position.

Some heel support devices may include an elongated tip that extends rearward from the center segment of the uppermost slat to further increase the ease of foot entry. FIG. 18 shows a heel support device 410 alike in all aspects to heel support device 10 except that the center segment 22 of the uppermost slat 12A includes an elongated tip 70 that extends rearwardly from the center segment 22. An upper surface 72 of the elongated tip 70 slopes downward and inward in a direction toward the foot-receiving cavity 50 when the heel support device 410 is disposed at and secured in position at the rear of the upper 42 in an article of footwear 440 as shown in FIG. 24. This downward and inward slope provides a ramp for the foot 60 that leads the foot 60 into the foot-receiving cavity 50 of FIG. 23. In FIG. 18, the upper surface 72 may have a discontinuity point P1 at which the slope of the upper surface 72 increases in a forward direction (e.g., in a direction from the rear 20 toward the front 74 of the device 10) and taken along a longitudinal midline LM of the article of footwear 440 in which the device 410 is secured (see FIGS. 23 and 25). For example, the slope of the surface 72 rearward of the point P1 is constant (e.g., the portion of the surface 72 rearward of the discontinuity point P1 is flat), whereas the slope of the portion 72A of the surface 72 forward of the discontinuity point P1 is nonlinear. This change in slope of the surface 72 will further increase the ramp effect of the elongated tip 70. Alternatively, the upper surface 72 may extend without a discontinuity point, the discontinuity point may be more rearward on the upper surface 72, or there may be more than one discontinuity point on the upper surface 72 at which the slope changes. As shown, the upper surface 72 rearward of the discontinuity point P1 extends generally at the same angle relative to a horizontal plane as do the medial arms 24 (FIG. 20) and the lateral arms 26 (FIG. 21) when the heel support device 410 is in the unloaded position of FIG. 18. Still further the elongated tip 70 may be configured to tip more forward or more rearward than shown in FIGS. 20 and 21, which may result in a greater change of curvature at a discontinuity point along the surface 72.

Figure 19:
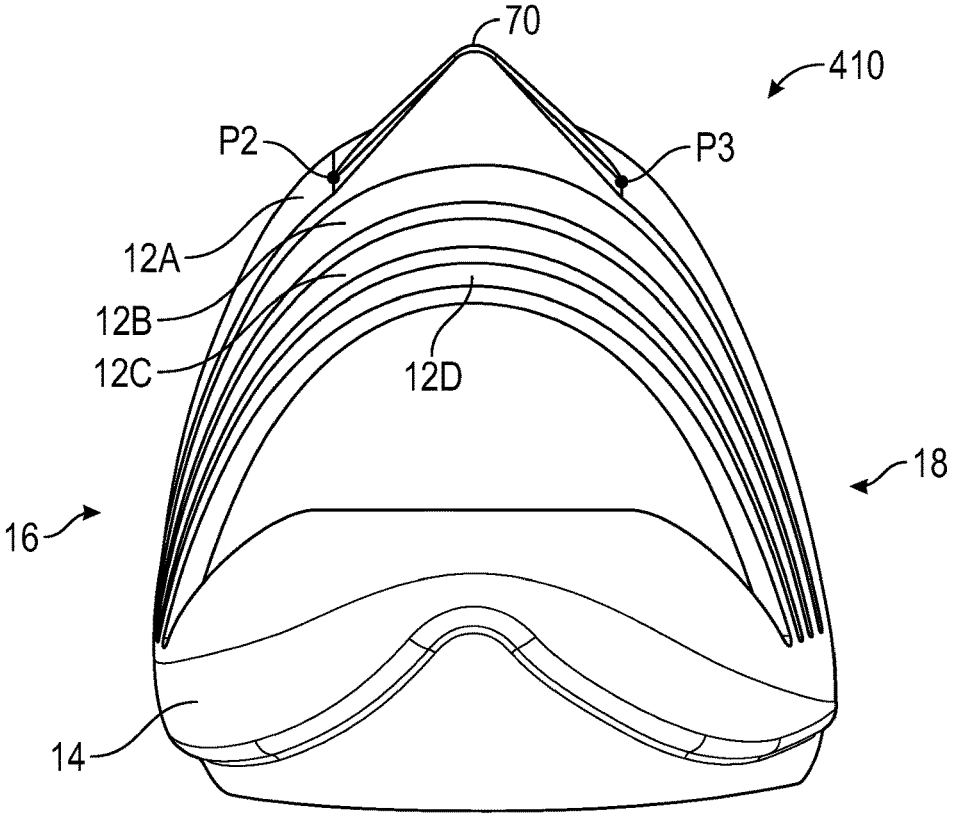
FIG. 19 is a rear view of the heel support device of FIG. 18.
Figure 22:
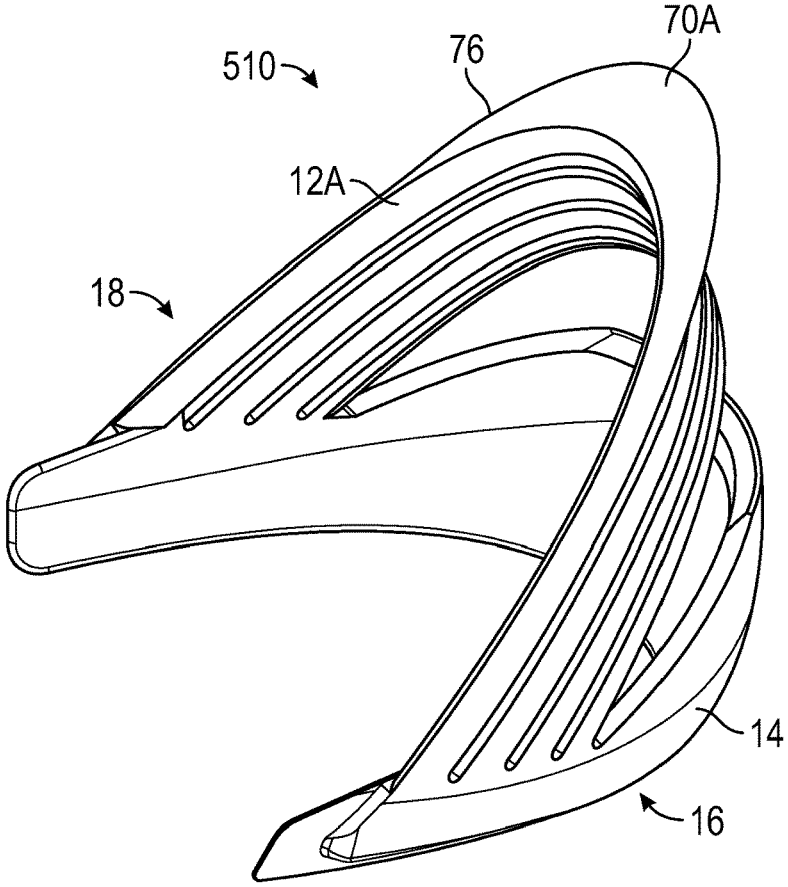
FIG. 22 is a perspective view of another heel support device.

FIG. 18 also shows that the outer perimeter 76 of the center segment 22 of the uppermost slat 12A has discontinuity points P2 and P3 at either side of the elongated tip 70 at which the elongated tip 70 diverges from the remainder of the slat 12A. The discontinuity points P2 and P3 are also shown in the rear view of FIG. 19 and in the medial and lateral views. By providing the discontinuity points P2 and P3, the position of the elongated tip 70 is easily visually located by a person prior to foot entry as it more sharply and distinctly extends from the uppermost slat 12A than would an elongated tip that follows the same curvature of the uppermost slat 12A without a discontinuity point. For example, an alternative elongated tip 70A without discontinuity points at the outer perimeter 76 of the uppermost slat 12A is shown extending rearward from the uppermost slat 12A of the heel support device 510 in FIG. 22. The heel support device 510 is configured identically to the heel support device 410 except for the alternative elongated tip 70A. The alternative elongated tip 70A characterized by the absence of any discontinuity point at the outer perimeter 76 of the uppermost slat 12A provides the benefit of a broader expanse (e.g., wider elongated tip 70A) on which to set the foot during depression of the device 510 to the loaded position.

Figure 25:
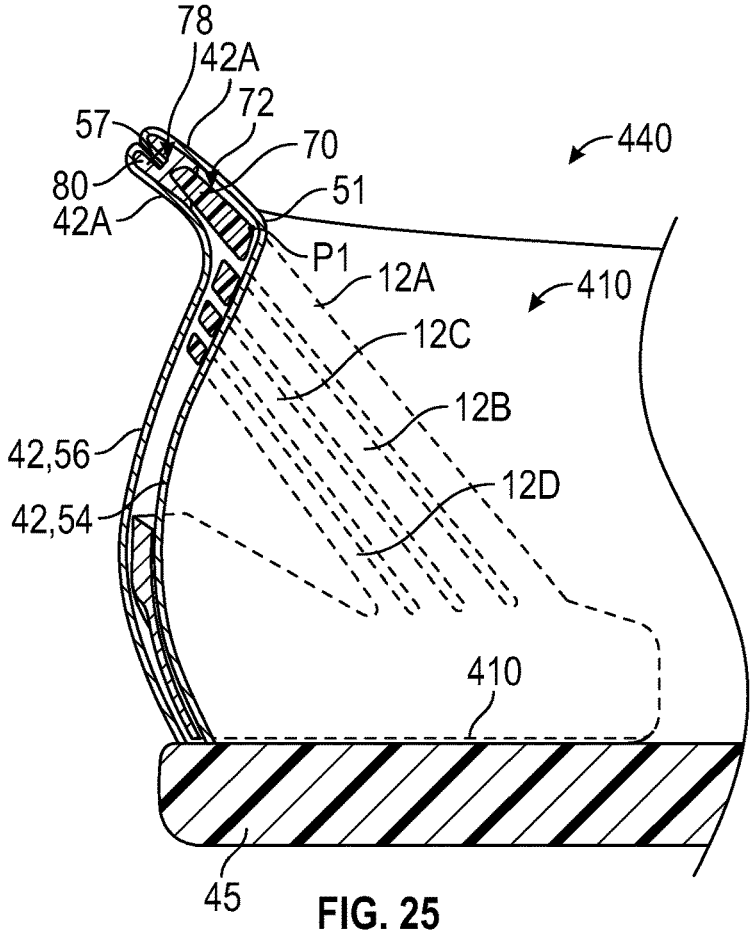
FIG. 25 is a fragmentary cross-sectional view of the article of footwear of FIG. 24 taken at lines 25-25 in FIG. 24.

FIG. 25 is a cross-section taken through the footwear 440 at the longitudinal midline LM. The upper 42 has a tapered extension 42A extending rearward from the heel collar 51 and overlaying the elongated tip 70. Because the device 410 is disposed within the upper 42, the upper 42 also overlays each of the medial arm 24 and the lateral arm 26 of the uppermost slat 12A. In other embodiments, the upper 42 may instead overlay only an arm of the device 410, such as a medial arm or a lateral arm instead of the elongated tip. In still further embodiments, the upper may overlay only the elongated tip and not the arm or arms of the device. The tapered extension 42A forms an internal cavity 78, and the elongated tip 70 is disposed in the internal cavity 78. More specifically, the inner layer 54 and the outer layer 56 are stitched to one another at an inverted seam 57, and the elongated tip 70 as well as padding 80 is disposed in the internal cavity 78. In some embodiments, the interfitting of the elongated tip 70 with the extension 42A of the heel collar 51 is enough to secure the upper 42 relative to the device 410 so that the upper 42 moves downward with the device 410 during depression to the access position and back upward to the use position after the depressing force F (e.g., the load) is removed such that no pegs 62 or other attachments of the slats 12 to the upper 42 are included.

Figure 26:
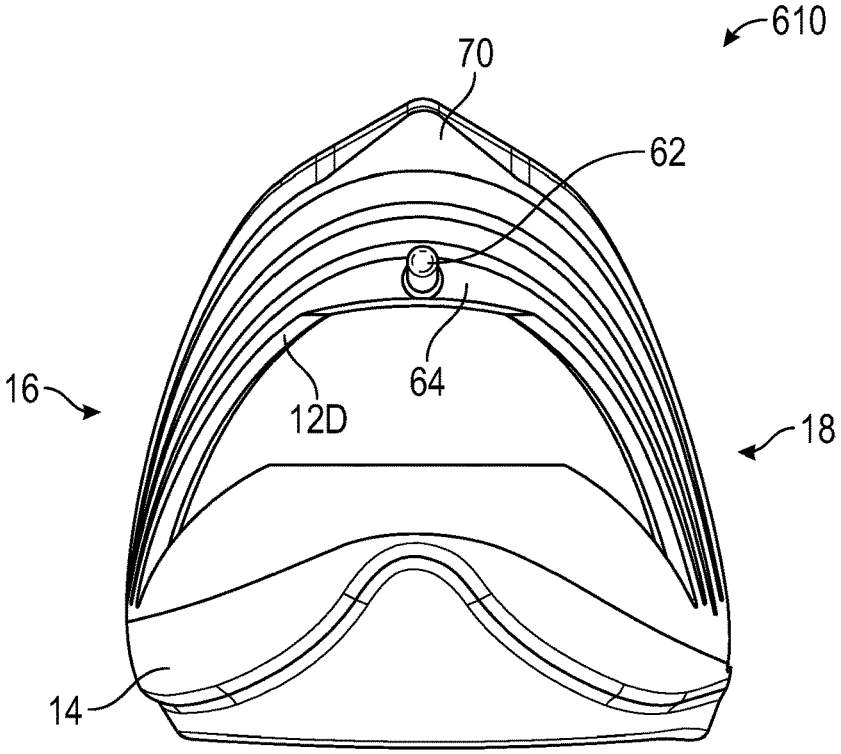
FIG. 26 is a rear view of another heel support device.
Figure 27:
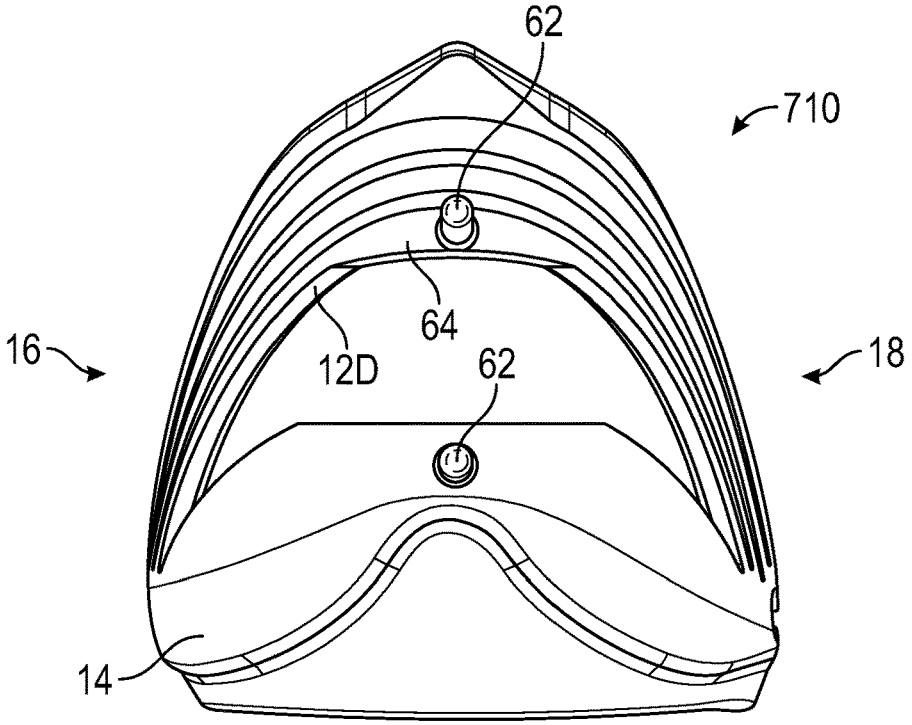
FIG. 27 is a rear view of another heel support device.
Figure 28:
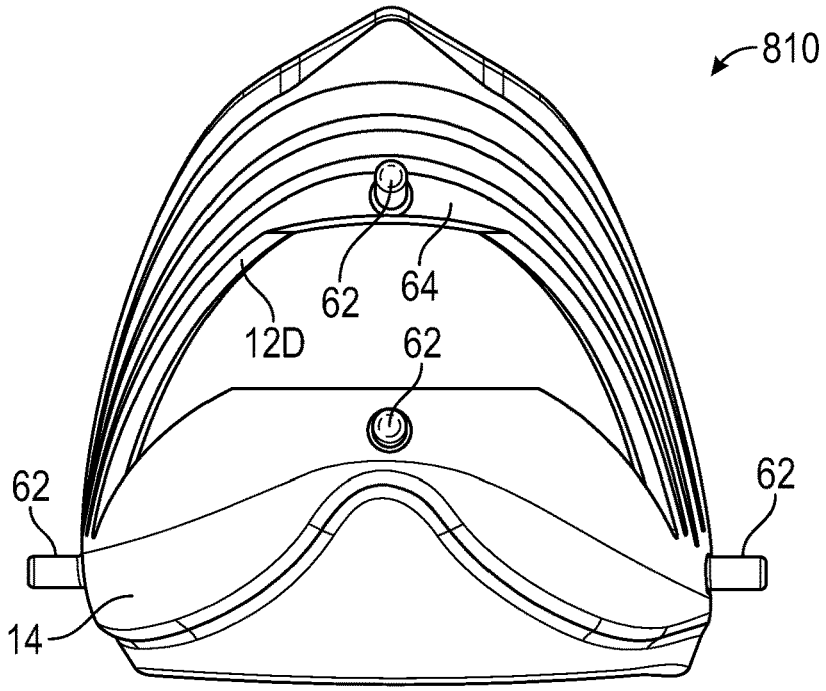
FIG. 28 is a rear view of another heel support device.

FIG. 26 shows a heel support device 610 alike in all aspects to heel support device 410 except that a peg 62 extends rearward from the lowermost slat 12D. The peg 62 may extend through an aperture in the outer layer 56 of the upper 42 and be secured to the outer layer 56 of the upper 42 in the same manner (e.g., by radio-frequency welding or otherwise) and providing the same advantages as described with respect to heel support device 110 in FIGS. 14 and 15. FIG. 27 shows an embodiment of a heel support device 710 that is alike in all aspects to heel support device 610 except that an additional peg 62 extends rearward from the rear of the base 14. This lower peg 62 helps to secure the outer layer 56 of the upper 42 to the base 14 when it extends through a corresponding aperture in the outer layer 56 and is welded to the outer surface 63 of the outer layer 56. FIG. 28 shows an embodiment of a heel support device 810 that is alike in all aspects to heel support device 610 except that three additional pegs are added for a total or four pegs 62. In addition to the peg 62 that extends from the lowermost slat 12D and the peg 62 that extends from the rear of the base 14, a peg 62 extends from the base 14 at the medial side 16, and a peg 62 extends from the base 14 at the lateral side 18. The four pegs 62 may be secured to the upper 42 in a similar manner as the four pegs 62 on the heel support device 310 of FIG. 17.

The features and advantages of the heel support devices described herein may be provided in combination or separately to enable the increased functionality and ease of entry to footwear as described. Additionally, the following commonly-owned, co-pending applications are incorporated by reference in their entireties: U.S. Nonprovisional application Ser. No. 15/793,008 filed Oct. 25, 2017 (now published as US 2018/0110292); U.S. Nonprovisional application Ser. No. 16/008,797 filed on Jun. 14, 2018 (now published as US 2018/0289109); U.S. Nonprovisional application Ser. No. 16/689,590 filed Nov. 20, 2019; and U.S. Nonprovisional application Ser. No. 16/689,665 filed Nov. 20, 2019.

The following Clauses provide example configurations of an article of footwear disclosed herein.

Clause 1. An article of footwear comprising: an upper defining a foot-receiving cavity with a heel region; a heel support device disposed at and/or in and/or secured in position at a rear portion of the upper, extending around the rear of a heel region, and including a plurality of slats and a base; wherein each slat has a center segment and an arm extending downwardly and forwardly from the center segment to the base; each slat resiliently bendable between an unloaded position and a loaded position when depressed toward the base from the unloaded position to the loaded position, the center segment spaced further apart from the base in the unloaded position than in the loaded position; the plurality of slats including an uppermost slat, a lowermost slat closer to the base than the uppermost slat, and at least one intermediate slat disposed between the uppermost slat and the lowermost slat; and wherein the plurality of slats includes a progressive gradient of lengths and/or widths from the lowermost slat to the uppermost slat.

Clause 2. The article of footwear of clause 1, wherein: the lowermost slat is shorter and thinner than the at least one intermediate slat; and the at least one intermediate slat is shorter and thinner than the uppermost slat.

Clause 3. The article of footwear of any of clauses 1-2, wherein the heel support device includes at least one peg extending through an aperture in the upper and secured at a surface of the upper.

Clause 4. The article of footwear of clause 3, wherein: the upper includes an inner layer and an outer layer; the aperture extends through the outer layer; and the heel support device is disposed between the inner layer and the outer layer.

Clause 5. The article of footwear of clause 3, wherein the at least one peg extends from the center segment of one slat of the plurality of slats.

Clause 6. The article of footwear of clause 5, wherein the at least one peg is a single peg.

Clause 7. The article of footwear of clause 6, wherein: the single peg extends outward from the lowermost slat of the plurality of slats.

Clause 8. The article of footwear of any of clauses 1-7, wherein one of the center segments includes an elongated tip extending rearwardly.

Clause 9. The article of footwear of clause 8, wherein the elongated tip extends from an uppermost slat of the plurality of slats.

Clause 10. The article of footwear of clause 8, wherein: the upper has a heel collar defining an opening into the foot-receiving cavity; the upper has a tapered extension extending rearward from the heel collar; and the tapered extension of the heel collar overlays the elongated tip.

Clause 11. The article of footwear of clause 10, wherein the tapered extension of the heel collar forms an internal cavity, and the elongated tip is disposed in the internal cavity of the tapered extension of the heel collar.

Clause 12. The article of footwear of clause 10, wherein an upper surface of the elongated tip slopes downward and inward toward the foot-receiving cavity.

Clause 13. The article of footwear of clause 12, wherein a slope of the upper surface of the elongated tip increases in a forward direction along a longitudinal midline of the article of footwear, providing a ramp.

Clause 14. The article of footwear of clause 12, wherein the upper surface of the elongated tip includes a discontinuity point.

Clause 15. The article of footwear of clause 12, wherein an outer perimeter of the center segment has a discontinuity point at the elongated tip.

Clause 16. The article of footwear of clause 12, wherein an outer perimeter of the center segment is characterized by an absence of a discontinuity point at the elongated tip.

Clause 17. The article of footwear of any of clauses 1-16, wherein the base includes a relatively thick portion adjacent an uppermost extent of the base and a relatively thin portion adjacent a lowermost extent of the base.

Clause 18. The article of footwear of clause 17, wherein the upper is sewn or adhered to the relatively thin portion of the base.

Clause 19. An article of footwear comprising: an upper defining a foot-receiving cavity with a heel region, the upper having a heel collar defining an opening into the foot-receiving cavity, and the upper having a tapered extension extending rearward from the heel collar; a heel support device extending around a rear of a heel region and including a control bar and a base, the control bar having a center segment and an arm extending downwardly and forwardly from the center segment to the base; wherein the control bar is resiliently bendable between an unloaded position and a loaded position, and is depressible toward the base from the unloaded position to the loaded position, the center segment spaced further apart from the base in the unloaded position than in the loaded position; the center segment including an elongated tip extending rearwardly; and the tapered extension of the heel collar overlaying the elongated tip.

Clause 20. The article of footwear of clause 19, wherein the tapered extension of the heel collar forms an internal cavity, and the elongated tip is disposed in the internal cavity of the tapered extension of the heel collar.

Clause 21. An article of footwear comprising: an upper defining a foot-receiving cavity with a heel region, the upper having a heel collar defining an opening into the foot-receiving cavity; a heel support device extending around a rear of a heel region and including a control bar and a base, the control bar having a center segment and an arm extending downwardly and forwardly from the center segment to the base; wherein the control bar is resiliently bendable between an unloaded position and a loaded position, and is depressible toward the base from the unloaded position to the loaded position, the center segment spaced further apart from the base in the unloaded position than in the loaded position; the center segment including an elongated tip extending rearwardly; and wherein the upper overlays at least one of the arm and the elongated tip.

Clause 22. The article of footwear of clause 21, wherein the upper overlays each of the arm and the elongated tip.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A device for easing foot entry into an article of footwear, the device comprising:

a control bar and a base underlying the control bar;

wherein the control bar includes a plurality of slats, the plurality of slats including an uppermost slat, a lowermost slat closer to the base than the uppermost slat, and at least one intermediate slat disposed between the uppermost slat and the lowermost slat; each slat of the plurality of slats having:

a center segment;

a medial side arm extending from the center segment to a medial end connected to a medial side of the base; and a lateral side arm extending from the center segment to a lateral end connected to a lateral side of the base; wherein the center segments of the plurality of slats progressively increase in width from the lowermost slat to the uppermost slat, with the center segment of the at least one of the intermediate slat being wider than the center segment of the lowermost slat, and the center segment of the uppermost slat being wider than the center segment of the at least one intermediate slat; and wherein the control bar is resiliently bendable between an unloaded position and a loaded position in which at least one center segment is closer to the base than in the unloaded position.

2. The device of claim 1, wherein the medial side arms of the plurality of slats progressively increase in width from the lowermost slat to the uppermost slat.

3. The device of claim 1, wherein the lateral side arms of the plurality of slats progressively increase in width from the lowermost slat to the uppermost slat.

4. The device of claim 1, wherein:

the center segment of the uppermost slat has an elongated tip; and an upper surface of the elongated tip has a slope that increases in a forward and downward direction.

5. The device of claim 1, further comprising:

a peg extending from the center segment of one of the plurality of slats in a direction away from the medial side arm and the lateral side arm.

6. The device of claim 5, wherein the peg extends from the lowermost slat.

7. The device of claim 5, wherein the peg extends outward from a thickened region of the center segment.

8. The device of claim 5, wherein the peg is a first peg, and further comprising:

a second peg extending outward from a rear of the base.

9. The device of claim 8, further comprising:

a third peg extending from a medial side of the base; and a fourth peg extending from a lateral side of the base.

10. The device of claim 1, wherein:

the base includes a relatively thick portion adjacent an uppermost extent of the base and a relatively thin portion adjacent a lowermost extent of the base; and the relatively thin portion has a greater height at a center of a rear of the base than the relatively thick portion.

11. The device of claim 10, wherein the relatively thick portion has a greater height at medial and lateral sides of the base than the relatively thin portion.

12. An article of footwear comprising:

an upper defining a foot-receiving cavity with a heel region, the upper having a heel collar defining an opening into the foot-receiving cavity;

wherein the upper includes and inner layer and an outer layer, the inner layer and the outer layer defining an internal cavity; and a heel support device extending around a rear of a heel region and including a control bar and a base, wherein both the control bar and the base are in the internal cavity;

wherein the control bar includes a plurality of slats, the plurality of slats including an uppermost slat, a lowermost slat closer to the base than the uppermost slat, and at least one intermediate slat disposed between the uppermost slat and the lowermost slat; each slat of the plurality of slats having:

a center segment;

a medial side arm extending from the center segment to a medial end connected to a medial side of the base; and a lateral side arm extending from the center segment to a lateral end connected to a lateral side of the base;

wherein;

the control bar is resiliently bendable between an unloaded position and a loaded position in which at least one center segment is closer to the base than in the unloaded position;

the center segments of the plurality of slats progressively increase in width from the lowermost slat to the uppermost slat;

the base includes a relatively thick portion adjacent an uppermost extent of the base and a relatively thin portion adjacent a lowermost extent of the base; and the upper is sewn or adhered to the relatively thin portion of the base.

13. The article of footwear of claim 12, wherein the center segment of one slat of the plurality of slats includes an elongated tip extending rearwardly.

14. The article of footwear of claim 13, wherein:

the upper has a tapered extension extending rearward from the heel collar;

the center segment of the uppermost slat has the elongated tip; and the elongated tip is disposed in the internal cavity at the tapered extension of the heel collar.

15. The article of footwear of claim 14, wherein an upper surface of the elongated tip slopes downward and inward toward the foot-receiving cavity.

16. The article of footwear of claim 12, wherein the heel support device includes a peg extending through an aperture in the upper and secured at a surface of the upper.

17. A device for easing foot entry into an article of footwear, the device comprising:

a control bar and a base underlying the control bar;

wherein the control bar includes a plurality of slats, the plurality of slats including an uppermost slat, a lowermost slat closer to the base than the uppermost slat, and at least one intermediate slat disposed between the uppermost slat and the lowermost slat; each slat of the plurality of slats having:

a center segment;

a medial side arm extending from the center segment to a medial end connected to a medial side of the base; and a lateral side arm extending from the center segment to a lateral end connected to a lateral side of the base; wherein the center segments of the plurality of slats progressively increase in width from the lowermost slat to the uppermost slat; and wherein:

the control bar is resiliently bendable between an unloaded position and a loaded position in which at least one center segment is closer to the base than in the unloaded position;

the base includes a relatively thick portion adjacent an uppermost extent of the base and a relatively thin portion adjacent a lowermost extent of the base; and the relatively thin portion has a greater height at a center of a rear of the base than the relatively thick portion.

18. The device of claim 17, wherein the relatively thick portion has a greater height at medial and lateral sides of the base than the relatively thin portion.

* * * * *